US006035171A

United States Patent [19]

Takaya et al.

[11] Patent Number: 6,035,171

[45] Date of Patent: Mar. 7, 2000

[54] DEVELOPING APPARATUS HAVING MEANS FOR REMOVING ELECTRIC CHARGE OF TONER

[75] Inventors: Toshihiko Takaya, Nara; Nobuyuki Azuma, Ibaraki; Masanori Yamada, Ikoma; Atsushi Inoue, Ikoma-gun; Keiji Yasuda, Nishinomiya; Takayuki Yamanaka, Tenri; Tadashi Iwamatsu, Nara; Kazuhiro Matsuyama, Ikoma; Hiroshi Tatsumi, Shiki-gun; Katsumi Adachi, Nara; Yukihito Nishio, Ikoma-gun, all of Japan

[73] Assignee: Sharp Kabushiki Kaisha, Osaka, Japan

[21] Appl. No.: 09/244,582

[22] Filed: Feb. 4, 1999

[30] Foreign Application Priority Data

Feb. 4, 1998 [JP] Japan ..... 10-023559
Dec. 1, 1998 [JP] Japan ..... 10-342073

[51] Int. Cl.[7] ..... G03G 15/08

[52] U.S. Cl. ..... 399/281; 399/285

[58] Field of Search ..... 399/285, 284, 399/281, 252, 53, 55

[56] References Cited

U.S. PATENT DOCUMENTS

| | | | |
|---|---|---|---|
| 4,656,965 | 4/1987 | Hosoya et al. | 399/284 |
| 4,745,429 | 5/1988 | Mukai et al. | 399/281 X |
| 4,930,438 | 6/1990 | Demizu et al. | 399/281 |
| 5,552,870 | 9/1996 | Murakami et al. | 399/281 |
| 5,568,236 | 10/1996 | Toda et al. | 399/285 |
| 5,600,419 | 2/1997 | Sakuraba et al. | 399/285 |
| 5,634,177 | 5/1997 | Taguchi et al. | 399/103 |
| 5,708,921 | 1/1998 | Yagi et al. | 399/98 |
| 5,781,827 | 7/1998 | Shimada et al. | 399/55 |

FOREIGN PATENT DOCUMENTS

| | | |
|---|---|---|
| 55-095956 | 7/1980 | Japan . |
| 55-159467 | 12/1980 | Japan . |
| 60-205472 | 10/1985 | Japan . |
| 3-087759 | 4/1991 | Japan . |
| 7-301995 | 11/1995 | Japan . |
| 10-228173 | 8/1998 | Japan . |

*Primary Examiner*—Sophia S. Chen
*Attorney, Agent, or Firm*—Renner, Otto, Boisselle & Sklar, P.L.L.

[57] ABSTRACT

The object of the invention is to certainly remove and certainly recover the charged toner remaining on a developing roller after development. A single component toner which is delivered to the developing roller via a toner-supplying roller is made into a relatively thin layer of a predetermined thickness with a charging plate and is frictionally charged with a given quantity of electric charge. Subsequently, the toner is adhered on a photoreceptor drum along by the electrostatic latent image to develop an image at the developing region at which the developing roller comes into contact with the photoreceptor drum. After development, the electric charge of the toner layer on the developing roller is removed with an electric-charge-removing sheet. The toner after development is recovered into a toner hopper via the toner-supplying roller. In rotation direction of the developing roller, the relation of the width Wt of the toner layer to the width Wc of the electric-charge-removing sheet is established so as to be Wc≧Wt. Thus, the electric charge of the toner layer on the developing roller is certainly removed.

23 Claims, 12 Drawing Sheets

DEVELOPING APPARATUS HAVING MEANS FOR REMOVING ELECTRIC CHARGE OF TONER

BACKGROUND OF THE INVENTION

1. Field of the Invention

The present invention relates to a developing apparatus which is used in an electrophotographic apparatus. Particularly, the invention relates to a developing apparatus in which a developing roller carrying a single component toner is contacted with a photoreceptor drum carrying an electrostatic latent image to develop the electrostatic latent image with toner.

2. Description of the Related Art

In developing apparatuses using a single component but not any carrier, miniaturization can be achieved inexpensively and maintenance cost is low since their structure is relatively simple. Particularly, in the case of using no magnetic toner, an inexpensive small-sized apparatus that develops a clear picture can be put into practice because no magnetic roller is necessitated. The developing apparatuses using a non-magnetic single component toner can be classified roughly into two types. In one apparatus of a non-contact type, a photoreceptor drum carrying an electrostatic latent image is placed at the opposite side of a developing roller carrying toner without contact, in which an alternating current electric field is applied between them for the toner to flit reciprocally to develop an image. In another, contact type apparatus, the photoreceptor drum is contacted with and placed at the opposite side of a developing roller comprising a conductive elastic material, to which voltage is applied to develop an image. In the apparatus of non-contact type, developing bias voltage in which an AC voltage is mainly superimposed on a DC voltage is used, and in that of contact type, DC developing bias voltage is used.

For example, in Japanese Unexamined Patent Publication JP-A 3-87759 (1991) which discloses a developing method of the contact type in the prior art, necessity of difference in the relative velocity between the photoreceptor drum and the developing roller required for highly precise development, resistance value of the toner, and resistance value of the developing roller are disclosed. Moreover, in Japanese Examined Patent Publication JP-B2 63-26386 (1988) which discloses a developing method of the contact type of the prior art, a method for removing the electric charge of toner remaining in the roller by a conductive member contacting with the developing roller after completion of the development is disclosed. Furthermore, in Japanese Examined Patent Publication JP-B2 6-52448 (1994) which discloses a developing method of the contact type of the prior art is defined the relationship between coefficient of internal friction in a developing apparatus provided with a blade for regulating the toner on the developing roller in thickness, coefficient of friction of the toner with the developing roller, and coefficient of friction of the toner with the blade. Furthermore, Japanese Examined Patent Publication JP-B2 63-26391 (1988) discloses an apparatus for electrostatically or mechanically removing toner adhered to a part other than an image part by applying a voltage of the same polarity as that of the toner to the conductive member a developing apparatus in which a developing apparatus including a developing roller, a conductive member and transfer apparatus are sequentially disposed around the photoreceptor drum along with a rotating direction of the photoreceptor drum.

The conditions disclosed in the JP-A 3-87759 (1991) and JP-B2 6-52448 (1994) are insufficient for highly precise development since removal of the electric charge of toner remaining in the developing roller after completion of the development has not been considered. Moreover, in JP-B2 63-26386 (1988), the electric charge of toner remaining in the developing roller after completion of the development is removed by using a conductive member, but mere contact of the conductive member with the developing roller is accompanied by a fall, accumulation and scattering of the toner to make the inside of the apparatus dirty to probably soil copy sheets. Further, there is no detail description of conditions for the development, and so highly precise development is desired. Further, JP-B2 63-26391 (1988) relates to removal of the toner excessively adhered to the photoreceptor drum but not to the toner adhered on the developing roller.

SUMMARY OF THE INVENTION

The purpose of the invention is to provide a developing apparatus in which the electric charge of toner remaining on a developing roller after completion of the development is removed certainly and the toner can easily be recovered.

The invention provides a developing apparatus comprising:

- a rotary photoreceptor drum for carrying an electrostatic latent image;
- developing means including a rotary conductive developing roller for carrying a single component toner which roller is placed in contact with the photoreceptor drum, and means for applying a voltage to the developing roller;
- electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and
- means for removing electric charge, including an electric-charge-removing member for removing electric charge which is placed at a lower stream side of the rotating direction of the developing roller than the developing position, and means for applying a voltage to the electric-charge-removing member,
- wherein a width Wt of the toner layer on the developing roller in a direction of a rotating axis of the developing roller and an effective electric-charge-removing width Wc of the electric-charge-removing member satisfy a relation of $Wc \geqq Wt$, and an elastic member is provided at a side of the electric-charge-removing member which side is opposite to the developing roller side.

According to the invention, a single component toner carried on the developing roller is firstly delivered to the charging member by the developing roller. The toner is formed into a relatively thin layer of a predetermined thickness by the charging member. Moreover, the toner is charged so as to have a predetermined quantity of electric charge, by friction with the charging member to which a predetermined voltage has been applied. Subsequently, the toner is delivered to the developing position. At the developing position, the developing roller is in contact with the photoreceptor drum. The photoreceptor drum carries an electrostatic latent image, and the toner carried by the developing roller to which a voltage is applied by the voltage applying means is adhered to the photoreceptor drum along the latent image to visualize the latent image. Then, the toner remaining on the developing roller which has passed through the developing position is delivered to the electric-charge-removing member. The electric charge of the toner is removed by the electric-charge-removing member which has been applied a voltage by the voltage applying means. In addition, the toner image formed on the photoreceptor drum is transferred on copy paper, which is then processed through a fixing step to form a picture on the paper.

In such a developing apparatus, when Wc and Wt are established to be the same or Wc longer than Wt, it becomes possible to cover the whole toner layer on the developing roller with the electric-charge-removing member to totally remove the electric charge of the toner remaining on the developing roller after completion of the development.

Particularly, the electric-charge-removing member may preferably be made in a form of plate of an elastic material containing one of resin materials such as mixtures of PC (polycarbonate) and PBT (polybutylene terephthalate), nylon, PET (polyethylene terephthalate) fluorine-containing resin materials such as PTFE (polytetrafluorothylene), silicon-containing resin materials, polyurethane and PVDF (vinylidene polyfluoride, and one or more of conductive fine grain materials, carbon and $TiO_2$ (titania). Thus, since the toner sufficiently slips, the toner is prevented from remaining at an upper stream side of the electric-charge-removing member in the rotating direction of the developing roller with the result that the toner can be effectively and certainly recovered into the toner hopper.

Furthermore, the elastic member is provided at the side of the electric-charge-removing member which side is opposite to the developing roller side, and the electric-charge-removing member comes enough into contact with the developing roller to certainly remove the electric charge of toner remaining on the developing roller after completion of the development.

In particular, the elastic member is preferably made of a foam formed by foaming a dielectric material with a foaming agent. Thus, the contact area between the elastic member and the developing roller can surely be maintained to increase the electric-charge-removing effect and reduce a load by the contact.

It is preferable that the dielectric material is any one of EPDM (ethylenepropylene rubber), urethane, nylon, silicon, PET, PTFE, PVDF, natural rubber, nitrile butadiene rubber, chloroprene rubber, styrene-butadiene rubber, butadiene rubber, isoprene rubber and polynorbornene rubber. These dielectric materials are stably foamed to yield a foam readily.

It is preferable that the foaming agent is of nitrogen type. The foaming agent makes fine foam of uniform particle size within the dielectric materials.

It is preferable that the aforementioned dielectric material is any one of propylene oxide, ethylene oxide, polyether polyol, tolylene diisocyanate, 5-butanediol, silicon-type surface activator and dibutyltin dilaurate, or is made by chemical reaction of two or more selected therefrom. With these materials, the foaming characteristics become stable independent of temperatures in the foaming step or lots of materials. Thus, a foam having a cell density of about 80 cells/inch to 100 cells/inch can be obtained.

It is preferable that the elastic member contains an electric resistance controlling material, which is preferably one or more of conductive fine particle materials, carbon and $TiO_2$. The controlling material reduces fluctuation of electric characteristics by controlling electric resistance and affords steadily voltage necessary for electric charge removal to the toner by the electric-charge-removing member.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a width Wt of the toner layer on the developing roller in a direction of a rotating axis of the developing roller and an effective electric-charge-removing width Wc of the electric-charge-removing member satisfy a relation of $Wc \geqq Wt$, and wherein a length L of contact of the developing roller with the electric-charge-removing member in the rotating direction of the roller, a rotating speed $v_t$ of the developing roller, a dielectric constant $\epsilon$ of the electric-charge-removing member, a vacuum permittivity $\epsilon_o$, and a volume resistivity $\rho$ satisfy a relationship of $L \geqq 10\ v_{t\epsilon\epsilon o}\rho$.

According to the invention, Wc and Wt are established to be the same or Wc longer than Wt, and L and $10\ v_t\epsilon\epsilon_o\rho$ are established to be the same or L larger than $10\ v_t\epsilon\epsilon_o\rho$. Accordingly it becomes possible to surely make the developing roller contact with the electric-charge-removing member sufficiently to remove the electric charge of the toner remaining in the developing roller even though the electric-charge-removing member is made of metallic material, resin material, and the like.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness , which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a passing time t of the developing roller through the electric-charge-removing member, a dielectric constant $\epsilon$ of the electric-charge-removing member, a vacuum permittivity $\epsilon_o$, and a volume resistivity $\rho$ satisfy a relationship of $\epsilon\epsilon_o\rho<t$.

According to the invention, it becomes possible to remove thoroughly the electric charge of the toner remaining on the developing roller by establishing the passing time t to be larger than $\epsilon\epsilon_o\rho$ in the developing apparatus which includes no elastic member.

In the developing apparatus including the elastic member, it is preferable that the passing time t of the developing roller through the electric-charge-removing member, the combined dielectric constant $\epsilon_s$ of the electric-charge-removing member and the elastic member, the vacuum permittivity $\epsilon_o$, and the combined volume resistivity $\rho_s$ are established so as to satisfy the relationship of $\epsilon_s\epsilon_o\rho_s<t$. Thus, it becomes possible to remove thoroughly the electric charge of the toner remaining on the developing roller. For example, removal of the electric charge can be achieved stably independent of conditions of use as low humidity.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein an electric resistance value Rd of the electric-charge-removing member and an electric value Rt of the toner satisfy a relation of $Rd \approx Rt$.

According to the invention, it is possible to prevent a leak of the electric current between the electric-charge-removing member and the developing roller and also prevent an adverse influence on the developing process caused by destruction of voltage applying means or by dropping of the voltage for the development when Rd and Rt are established to be approximately the same.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein an electric-charge-removing current I, a toner mass per unit area m/a (wherein m is a mass of the toner layer on the developing roller) of the toner layer on the developing roller after passing of the toner through the charging member, a quantity of electric charge of the toner q/m (wherein q is a quantity of electric charge of the toner of the toner layer on the developing roller), a quantity of change in electric charge $\Delta q/m$ of the toner layer on the developing roller after passing of the toner through the developing position, a rotating velocity $v_t$ of the developing roller, and an effective width for electric charge removal Wc of the electric-charge-removing member satisfy a relation of $I \geqq -(m/a)\cdot(q/m+\Delta q/m)\cdot v_t\cdot Wc$.

According to the invention, the electric-charge-removing current I is set to be equal to or larger than $-(m/a)\cdot(q/m+\Delta q/m)\cdot v_t\cdot Wc$ in the aforementioned developing apparatus. In such a setting, the quantity of change in electric charge generated in the developing process has been considered, so that the electric charge of the toner remaining on the developing roller can steadily be removed.

Particularly, it is preferable that $0.5 \leqq -I/(m/a)\cdot(q/m+\Delta q/m)\cdot v_t\cdot Wc \leqq 10$. Thus, the change in quantity of the supplied toner caused by insufficient current for electric charge removal and the leak of the current to the developing roller caused by excess current for electric charge removal can be avoided and stable electric charge removal and development can be achieved.

It is preferable that the electric-charge-removing member is made by applying conductive fine particles to a plate member formed of an elastic resin. Thus, the compatibility of the elasticity with the electric characteristic can be achieved.

It is preferable that the voltage-applying means in the electric-charge-removing means is provided with a current limiter. Thus, trouble of the voltage-applying means can be prevented and stable electric charge removal can be attained.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a toner mass per unit area m/a of the toner layer on the developing roller after passage of the toner through the charging member, a quantity of electric charge q/m of the charged toner, a quantity of change in electric charge Δq/m of the toner layer on the developing roller after passing of the toner through the developing position, a rotating speed $v_t$ of the developing roller, an effective width for electric charge removal Wc of the electric-charge-removing member, a DC voltage Vd applied from the voltage-applying means of the electric-charge-removing means to the electric-charge-removing member, a DC voltage Vr applied from the voltage-applying means of the developing means to the developing roller, an electric resistance value Rd of the electric-charge-removing member, an electric resistance value Rt of the toner, and an electric resistance value Rr of the developing roller satisfy a relation of $(Vd-Vr) \geqq -(((m/a)\cdot(q/m+\Delta q/m)\cdot v_t\cdot Wc)\cdot(Rd+Rt+Rr))$.

According to the invention, (Vd−Vr) is set to be equal to or larger than $-(((m/a)\cdot(q/m+\Delta q/m)\cdot v_t\cdot Wc)\cdot(Rd+Rt+Rr))$ in the aforementioned developing apparatus. For example, even in the case of realizing the developing roller with a macromolecular material and conductive fine particles and also realizing the electric-charge-removing member with a resin material, since the applied voltage for the electric charge removal is determined in consideration of more exact resistance values of the developing roller and the electric-charge-removing member, the electric charge of the toner remaining in the developing roller can thoroughly be removed.

Particularly, when the applied voltage to the toner layer on the developing roller after passage of the toner through the developing position is represented by Vt, the thickness of the toner layer by dt, the thickness of the developing roller by dr, and the thickness of the electric-charge-removing member by dd, it is preferable that a relationship of $$\frac{(Vd-Vr)+Vt}{dt+dr+dd} < 36\times 10^6 \quad [V/m]$$

is satisfied. Thus, the electric potential is set within a range lower than breakdown electric field strength, so stable electric charge-removal can be attained.

It is also preferable that a relationship of $$\frac{(Vd-Vr)+Vt}{dt+dr+dd} < 3\times 10^6 \quad [V/m]$$

is satisfied. This is suitable to use of powdered toner. The powdered toner is smaller than the pellet one in particle size, so the voltage to be applied is determined in consideration of the thickness of air-containing toner layer. Thus, stable electric charge removal can be attained.

It is preferable that the toner contains one or more of silica, $TiO_2$ and magnetite as an external additive. Thereby, the contact area between the toner particles becomes small to increase the electric-charge-removing efficiency.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein an internal friction coefficient it of the toner, a friction coefficient $\mu$rt between the toner and the developing roller, and a friction coefficient $\mu$dt between the toner and the electric-charge-removing member satisify a relation of $\mu dt<\mu t<\mu rt$.

According to the invention, the toner can be recovered by setting the friction coefficients as $\mu dt<\mu t<\mu rt$ in the aforementioned developing apparatus without accumulating at the upper stream side of the rotating direction of the developing roller of the electric-charge-removing member, and stable electric charge-removal can be attained.

The invention provides a developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a resin material is applied to a developing roller side surface of the electric-charge-removing member so that an internal friction coefficient $\mu$t of the toner and a friction coefficient $\mu$dt between the toner and the electric-charge-removing member satisfy a relation of $\mu dt<\mu t$.

According to the invention, the toner can be recovered by applying a resin material at $\mu dt<\mu t$ in the aforementioned developing apparatus with no accumulation at the upper stream side of the rotating direction of the developing roller of the electric-charge-removing member, and stable electric charge-removal can be attained.

In the invention it is preferable that a surface roughness of the electric-charge-removing material contacting with the developing roller is selected within a range of 1/50 to ½ of a particle size of the toner.

According to the invention, the surface roughness of the electric-charge-removing material contacting with the developing roller is selected within a range of 1/50 to 1/2 of the particle size of the toner in a developing apparatus in which the friction coefficients are set at $\mu dt<\mu t<\mu rt$ or in a developing apparatus in which a resin material is applied so as to satisfy a relationship of $\mu dt<\mu t$, and so the toner can readily be recovered since the toner is freely movable and there is no accumulation at the electric-charge-removing member.

In the invention it is preferable that the electric resistance value Rd of the electric-charge-removing member is selected within a range of $1\times10^{-5}$ Ω to $1\times10^{6}$ Ω.

According to the invention, the electric resistance value Rd of the electric-charge-removing member becomes smaller than that of the toner layer by selecting within a range of $1\times10^{-5}$ Ω to $1\times10^{6}$ Ω in the aforementioned developing apparatus, so that the electric charge of the toner can rapidly be removed.

Particularly, it is preferable that the electric-charge-removing member is made with metallic materials. Thus, the electric charge on the toner surface is damped rapidly and steadily.

In the invention it is preferable that a portion of a region of the effective width for electric charge removal Wc of the electric-charge-removing member, beyond the width Wt of the toner layer on the developing roller in the rotating axis direction is provided so as not to contact with the developing roller.

According to the invention, a leak between the developing roller and the electric-charge-removing member in the aforementioned developing apparatus can be prevented by making the portion of the region of the effective width for electric charge removal Wc of the electric-charge-removing member, beyond the width Wt of the toner layer on the developing roller in the rotating axis direction of the developing roller, non-contact with the developing roller.

In the invention it is preferable that an electrically insulating member is formed on a surface of a portion of a region of the effective width for electric charge removal Wc of the electric-charge-removing member, beyond the width Wt of the toner layer on the developing roller in the rotating axis direction.

According to the invention, a leak between the developing roller and the electric-charge-removing member in the aforementioned developing apparatus can be prevented by forming the electrically insulating member on the surface of the portion of the region of the effective width for electric charge removal Wc of the electric-charge-removing member, beyond the width Wt of the toner layer on the developing roller in the rotating axis direction.

Particularly, it is appropriate to apply a fluororesin to the portion. Thus, the frictional resistance is decreased and turn-up and generation of noise in the electric-charge-removing member can be prevented.

In the invention it is preferable that the developing apparatus has a vessel for accommodating the toner and the electric-charge-removing member is fixed so as to be sandwiched between the vessel and a metallic member.

According to the invention, stable electric charge removal can be achieved by firmly fixing the electric-charge-removing member between the toner-containing vessel and the metallic member.

Particularly, it is preferable that the metallic member is a terminal for applying a voltage to the electric-charge-removing member. Thus, the voltage can be applied with no influence by intrusion of or dirtiness with toner, so that stable electric charge removal can be achieved.

In the invention it is preferable that voltage-applying means of the electric-charge-removing means applies an AC voltage VAC to the electric-charge-removing member.

According to the invention, the residual electric potential remaining on the surface or in the inner part of the toner particles which have not been used in the development and remained on the developing roller can be removed by applying the AC voltage VAC to the electric-charge-removing member.

Namely, when non-developed toner is used again in the next developing process without electric charge removal or elimination after termination of the toner developing process on the developing roller, the electric charge of the toner becomes non-uniform in the direction of the developing roller axis according to the background of the previous developing process, and produces a difference in electric charge or electric potential of the toner layer. The development that is carried out in such a non-uniform state produces a difference in quantity of toner to be developed and the background of the previous developing process, that is ghost, appears. Accordingly, in removing the electric charge, the electric-charge-removing member has to contact sufficiently with the whole region covering the toner layer width on the developing roller as mentioned above. For example, when the developing effective width (latent image width: the width of electric potential formed on the photoreceptor surface) is narrower than the toner layer width, the influence of the background in the previous developing process vanishes on an electric charge removal operation only for the effective width in each step of development, supplying toner and regulating the toner layer in thickness. When the development is repeated, however, the toner gradually accumulates on the developing roller to form a film, at which the toner is poor in electric charge to produce splashes and which sometimes hinders uniform contact between the developing roller and the photoreceptor drum to separate the charging member and the electric-charge-removing member.

According to the invention, the electric potential remaining on the toner particle surface can be removed by applying an AC voltage VAC to the electric-charge-removing member even though the developing roller does not contact uniformly with the electric-charge-removing member. Accordingly, when the development is repeated, no film is formed by gradual accumulation of the toner on the developing roller, no splash is produced by poor charge of the toner, nor no separation of the charging member or the electric-charge-removing member by hindered uniform contact of the developing roller with the photoreceptor drum occurs. Moreover, it is particularly appropriate to provide the elastic member in the above-mentioned fashion because the electric-charge-removing member can be contacted steadily with the developing roller and the electric charge of the toner remaining on the developing roller after development can be removed with reliability. Furthermore, the electric charge of the toner remaining on the developing roller after development can also be removed by applying the AC voltage VA to the electric-charge-removing member.

In the invention it is preferable that a relation of $2\times|Vd-Vr|<VAC$ is satisfied, in which VAC is an AC voltage applied to the electric-charge-removing member, Vd is an AC voltage applied by the voltage-applying means of the electric-charge-removing means, and Vr is an AC voltage applied by the voltage-applying means of the developing means.

According to the invention, a sufficient electric-charge-removing effect is attained by applying the AC voltage VAC to the electric-charge-removing member so as to satisfy the relation of $2\times|Vd-Vr|<VAC$. In other words, when the voltage applied for electric charge removal is a direct current, if the difference between the electric-charge-removing voltage and the developing voltage is not larger than the voltage applied to the toner layer at the opposite polarity, the electric-charge-removing effect could not be attained. This means that $|Vd-Vr|<Vt$ is necessary. This setting of the voltage, however, produces both of electric-charge-removed toner particles and electric charge-remaining toner particles. Accordingly, it is appropriate to add the AC application voltage VAC to the direct application voltage to satisfy the relation of $2\times|Vd-Vr|<VAC$. Particularly, more sufficient effect of electric charge removal can be attained by applying the AC voltage VAC to the electric-charge-removing member in order to satisfy the relation of $2\times|Vd-Vr-Vt|<VAC$.

In the invention it is preferable that the AC voltage VAC is applied to the electric-charge-removing member by the voltage-applying means of the electric-charge-removing means so that an effective electric field for the toner layer on the developing roller is approximately $3\times10^6$ V/m.

According to the invention, more sufficient effect of electric charge removal can be attained by applying the AC voltage VAC to the electric-charge-removing member so that the effective electric field for the toner layer is approximately $3\times10^6$ V/m. In other words, the surface electric charge of the toner particles can be removed by applying a direct voltage, but the electric charge being on the inside of the surface of toner particles or in the pits of irregular toner particles sometimes cannot be removed. When an AC voltage is applied in addition to the direct application voltage, high electric-charge-removing effect can be attained, and moreover, the electric charge of the toner particles can thoroughly be removed by applying the AC voltage VAC so that the effective electric field for the toner layer is approximately $3\times10^6$ V/m, which value is near to that of the discharge limit electric field of the toner particles.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
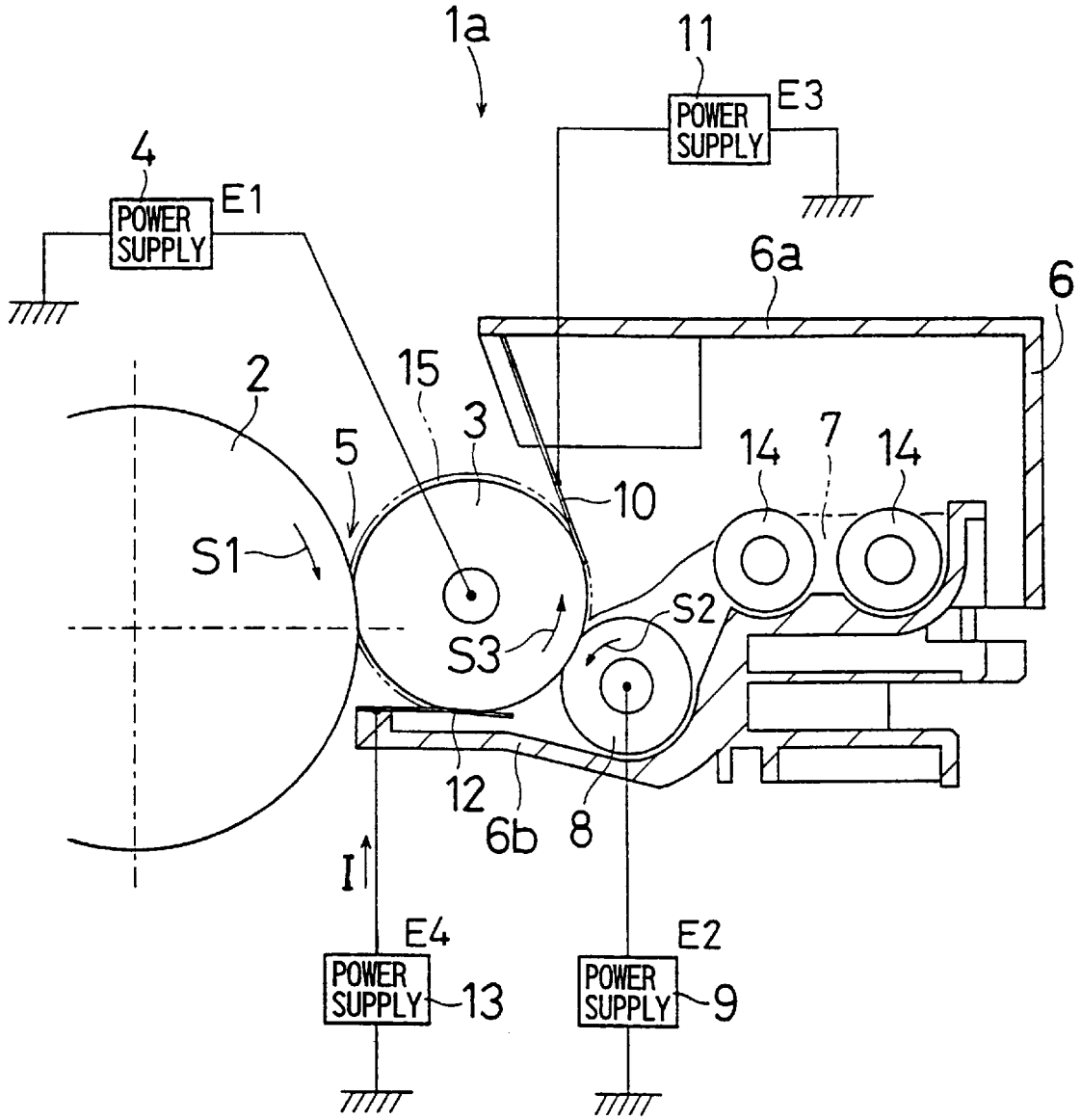
FIG. 1 is a sectional view showing a developing apparatus 1*a* of an embodiment of the invention.

Now referring to the drawings, preferred embodiments of the invention are described below.

FIG. 1 is a view showing a sectional view of a developing apparatus 1*a* of an embodiment of the invention. The developing apparatus 1*a* is used in an electrophotographic manner of which the whole structure can be realized by a well-known technique and include the steps of charging, exposure, development, transfer, cleaning, fixation and electric charge removal.

A photoreceptor drum 2 is provided so as to rotate in the direction of an arrow S1. A surface of the drum 2 is charged uniformly so as to have a predetermined quantity of electric charge, by electrically charging means such as corona charger or contact roller charger (not shown). Thus, the surface carries an electrostatic latent image by formation of a predetermined potential for a latent image by exposure means (not shown). The photoreceptor drum 2 comprises a metal or plastic conductive body, an underlayer formed on the surface, and a photoreceptive layer formed thereon. The photoreceptive layer comprises a relatively thin carrier-generating layer (CGL) formed on the underlayer, and a relatively thin carrier-transferring layer (CTL) mainly containing a polycarbonate formed on the outermost layer. A carrier is generated on the carrier-generating layer by exposure, by which carrier the electric charge formed on the photoreceptor drum 2 is cancelled to form the potential of electrostatic latent image.

The electrostatic latent image carried on the photoreceptor drum 2 is transferred to a developing area 5 which is in contact with a developing roller 3 on rotation of the drum 2. The developing roller 3 which rotates in the opposite direction to the arrow S1, i.e., the direction of an arrow S3, is tightly contacted to the photoreceptor drum 2 under pressure. Thus, the toner carried on the developing roller 3 is moved and adhered according to the latent image on the photoreceptor drum 2 to form an image, which is developed. To the developing roller 3 is applied a predetermined bias voltage E1 from a power source 4 connected thereto.

After completion of the development, the toner stuck on the photoreceptor drum 2 is transferred to a predetermined transfer area. In the transfer area (not shown), paper-supplying means is provided to supply a copy material such as paper to the area and comes into contact with the toner image on the photoreceptor drum 2 synchronously. The transfer means provided in the transfer area (not shown) is of a charger type or contact roller type equipped with a high tension power source, and applies the voltage with the polarity of the surface to which an image is to be transferred, to the photoreceptor drum 2. Thus, toner 7 is transferred to the copy material to form a toner image. The copy material is separated from the photoreceptor drum 2, and then the toner on the copy material is fixed by fixation means (not shown). The fixation means is exemplified by thermal fusion. The paper is discharged out of the apparatus. The surface of the photoreceptor drum 2 after transfer is cleaned by cleaning means (not shown), and the electric charge remaining on the surface is removed by electric-charge-removing means (not shown) to initialize the surface electrically. The electric-charge-removing means includes an optically electric-charge-removing lamp or contact electric-charge-removing apparatus.

As to the developing apparatus 1*a*, one component toner 7 is accommodated in a toner hopper 6 which is opened at the side of the developing area 5. The toner is agitated with an agitating supplying member 14 such as an agitator or screw and is supplied near a toner-supplying roller 8. The toner-supplying roller 8 which rotates in the same direction S2 as that (S3) of the developing roller 3, is in contact with the developing roller 3, for example, under pressure. In addition, to the toner-supplying roller 8 is applied a predetermined bias voltage E2 through a power source 9 connected thereto. The voltage E2 is designed to electrically move the toner 7 to the developing roller 3, for example, when the negatively charged toner is used, the voltage E2 of higher potential is applied to the negative electrode. The toner 7 is loaded with the electric charge by charge injection on the potential difference between the developing roller 3 and a toner-supplying roller 8 and also by charging by friction at the contact surface between the rollers 3 and 8, and is effectively supplied to the developing roller 3. The developing roller 3 and the toner-supplying roller 8 are established almost in the same way, and control of the electric resistance value can be achieved using the same controlling materials. Moreover, it is preferable to make the rollers practically with a foaming material in consideration of elasticity. In such a case, the toner-supplying roller 8 may preferably be practiced using a larger quantity of foam than in the developing roller 3.

The toner 7 stuck on the developing roller 3 is transferred near a charging plate 10 which is set at the upper stream side of the rotating direction of the developing roller in the developing area 5. For example, the charging plate 10, which is made of a plate metal material, is fixed at one end to an upper part 6*a* of the toner hopper 6, so that the other end of the plate is in contact at its edge or its vicinity with the surface of the developing roller 3 under pressure. To the charging plate 10 is applied a predetermined bias voltage E3 from a power source 11. With these operations, the toner layer on the developing roller 3 is charged with a predetermined quantity of electric charge and as well is formed into one having a predetermined thickness. The toner 7 stuck on the developing roller 3 is transferred to the aforementioned developing area 5, in which an electrostatic latent image is formed on the surface of the photo-receptive drum 2.

The toner 7 which has passed through the developing area 5 and remained on the developing roller 3 is delivered to a vicinity of an electric-charge-removing sheet 12 which is disposed at the downstream side of the rotating direction of the developing roller in the developing area 5. The electric-charge-removing sheet 12 is fixed, for example, to a lower part 6*b* of the toner hopper 6 so as to contact with the developing roller 3 under pressure. To the electric-charge-removing sheet is applied a predetermined bias voltage E4 from a power source 13. The bias voltage E4 is a DC or AC voltage as mentioned below. The electric charge of the toner 7 is removed with such electric-charge-removing sheet 12. The toner-supplying roller 8 is contacted under pressure with the developing roller 3 which moves reversely, and the toner 7 is thereby separated from the developing roller 3 and recovered in the toner hopper 6 and recycled. In this process, an image is formed repeatedly.

The followings are detailed explanation on the constituting elements and the setting condition in the developing apparatus 1*a* for performing contact inversion development. The photoreceptor drum 2, as mentioned above, has a conductive substrate which is grounded. The photoreceptor drum 2 has a surface electric potential of −550 V, a diameter of 55 mm, and a rotating speed of 185 mm/s.

The developing roller 3, to which an electric resistance regulator is added to make the volume resistivity $10^6$ Ωcm, is made by placing an elastic member of a hardness of 60 to 70 degree (JIS-A) on a conductive shaft. The developing roller 3 has 34 mm in diameter and its rotating speed is 280 mm/s. The shaft has 10 mm in diameter, to which a voltage E1 of −250 V is applied. The contact width of the photoreceptor drum 2 with the developing roller 3 in rotating direction, namely nip, is 2 mm.

The conductive shaft of the developing roller 3 may be made of a metal such as stainless steel or a resin of relatively low electric resistant. As for the elastic member placed on the shaft, resin materials having a dielectric constant of about 10, including EPDM, urethane, silicon, nitrile butadiene rubber, chloroprene rubber, styrene butadiene rubber, butadiene rubber, and the like, may be used. The electric resistance regulator includes conductive fine particles, carbon black, $TiO_2$, ionic conductive materials, and surface activators such as polydi-alkylsiloxane, polysiloxane-polyalkylene oxide block copolymer, etc., of which one or more may be used. When a foaming agent is used in making an elastic member, a surface activator of silicon type is best.

For example, the elastic member on the shaft may be made by means of thermally blowing foam formation by agitating a mixture of a predetermined amount of a resin as an elastic member and a predetermined amount of an electric resistance regulator with a mixing injector, pouring it into a metal mold, heating it at 80 to 120° C. for about 5 to 100 minutes, and extruding it. The elastic member may also be made on the shaft by an injection molding method, wherein the shaft is disposed at the center of a predetermined metal mold, into which an elastic member resin material is poured and heated for sulfurisation for about 100 to 160 minutes.

As for carbon black used as an electric resistance regulator, those having a specific surface area of 20 $m^2$/g to 130 $m^2$/g for absorbing nitrogen and an oil absorption of 60 ml/100 g to 120 ml/100 g for DBP are preferably used. For example, a preferred one includes those of ISAF, HAF, GPF and SRF grade. Particularly, furnace carbon and channel carbon are preferably used.

The polyurethane used as an elastic member resin material includes preferably light polyurethane foam and polyurethane elastomers. For example, 0.5 weight parts to 15 weight parts of carbon black, sometimes about 70 weight parts, is preferably mixed for 100 weight parts of polyurethane.

EPDM used as an elastic member resin material contains ethylene, propylene, and a third ingredient such as dichloropentadiene, ethylidenenorbornene, 5-hexadiene, and the like, whose contents are preferably 5 to 95 weight parts, 5 to 95 weight parts, and 0 to 50 weight parts as an iodine value, respectively. For example, 1 to 30 weight parts of carbon black such as furnace carbon or channel carbon is preferably mixed for 100 weight parts of EPDM. In addition to carbon black, an electric resistance regulator, for example, ionic conductive material such as sodium perchlorate or tetraethylammonium chloride, a surface activator such as dimethylpolysiloxane or polyoxyethylene lauryl ether, is preferably added in an amount of 0.1 to 10 weight parts to enhance dispersible homogenity.

The ionic conductive material used for electric resistance regulator includes inorganic ionic conductive materials such as sodium perchlorate, calcium perchlorate, and sodium chloride, and organic ionic conductive materials such as denatured aliphatic dimethylethylammonium ethosulfate, stearylammonium acetate, laurylammonium acetate, and octadecyltrimethylammonium perchlorate, of which one or more may be used.

It is preferable that the developing roller 3 has an electric resistance within a range of $1\times10^5$ Ω to $1\times10^6$ Ω, a volume resistivity within a range of $3.75\times10^5$ Ωcm to $7.5\times10^6$ Ωcm, hardness of 68 degree (JISK-6301; hardness meter Asker C; load 1 kgf), and a surface roughness Rz within a range of 1 μm to 6 μm (JISB0601). The hardness of the elastic member can be selected by the addition amount of curing agent or filler, hardness reduction can be achieved by increasing the addition amount thereof, however, the surface resistivity is lowered due to deposition of a low molecule curing agent or filler onto the surface of the elastic member. The method of measuring of electric resistance and volume resistivity is mentioned below, in which measurement is carried out by applying 200 V and imposing a load of 100 g on both ends of the shaft according to JISK-6911.

The toner-supplying roller 8 is realized by forming conductive polyurethane foam having a volume resistivity of $10^5$ Ωcm and a cell density of foam of about 3 to 4/mm on the shaft of stainless steel or conductive resin. The toner-supplying roller 8 has a diameter of 20 mm and a rotating speed of 160 mm/s. The voltage E2 of −350 V is applied to the shaft. The toner-supplying roller 8 is contacted in a depth of 0.5 mm to 1 mm by the developing roller 3. The toner 7 is pre-charged, for example, negatively, by the toner-supplying roller 8.

More specifically, into the polyurethane foam used for the toner-supplying roller 8 is mixed 5 to 15 weight parts, occasionally about 70 weight parts of carbon black for 100 weight parts of polyurethane foam. The same polyurethane foam and carbon black as those for the developing roller 3 may be used. A mixture of polyurethane foam and carbon black are stirred with a foamer and thereafter a sponge is formed around the shaft by heating and blowing to complete the toner-supplying roller 8.

It is preferable that the sponge formed around the shaft has a volume resistivity of $10^5$ Ω or less. Additionally it is preferable that the sponge has a cell density of 80 cells/inch to 100 cells/inch at a thickness of 6 mm, a density of 0.1 g/cm$^3$, an asker F hardness of 68 degree, and a hardness of 24.2 Kgf (JISK-6401). The method of measuring of volume resistivity is the same as that of the developing roller 3. As the sponge can be used EPT urethane conductive sponge having a volume resistivity of $10^4$ Ω, manufactured by Bridgestone.

The elastic member and sponge are formed on the shaft and thereafter polished, whereby the developing roller 3 and toner-supplying roller 8 having a predetermined (outer) diameter and surface roughness are completed.

The charging plate 10 is realized by stainless steel or a conductive resin having a thickness of 0.1 mm or the like to be provided in a cantilever plate spring mechanism. The voltage E3 of −350 V is applied to the charging plate 10. The deposition amount and quantity of electric charge of the toner on the developing roller 3 are regulated to 0.6 mg/cm$^2$ to 0.8 mg/cm$^2$ and to about −10 μC/g to −15 μC/g, respectively.

The electric-charge-removing sheet 12 is realized by an plate elastic member. The elastic member is made of a material in which one selected from a mixture resin of PC and PBT, nylon, PET, a fluorine containing resin such as PTFE, a silicon containing resin, polyurethane and PVDF is used as a base material and an electric resistance regulator such as carbon black is mixed therewith on an as needed basis. Ten weight parts or more of carbon black for 100 weight parts of elastic member resin material is mixed. The same carbon black as that used for the developing roller 3 may be used.

As the electric-charge-removing sheet 12 may be used, for example, an extrusion film of PC and PBT, Bayer AS-A film (product name) manufactured by Bayer. In the case of the film, since the toner sufficiently slips, the toner 7 does not remain at an upper stream side of the electric-charge-removing sheet 12 in the rotating direction of the developing roller with the result that the developing operation is not adversely affected and the toner 7 can be effectively recovered into the toner hopper 6. The film has a thickness of 0.3 mm±0.1 mm and an electric resistance of $10^3$ Ω to $10^6$ Ω. Such a film may be stuck to a lower part **6*b* of the toner hopper 6 by an adhesive tape, No. 500 made by Nitto. The above-mentioned effect is achieved even when the electric-charge-removing sheet 12** is formed of an elastic material which contains one selected from a mixture resin of PC and PBT, nylon, PET, a fluorine containing resin such as PTFE, a silicon containing resin, polyurethane and PVDF, and one or more selected from conductive particulate matters, carbon and $TiO_2$.

The material of the electric-charge-removing sheet 12 is not limited to the above-mentioned materials. When an AC voltage from the power source 13 is applied, a material is selected which has a small frequency dependence to the applied AC voltage dielectric dissipation factor and electric resistivity, contacts with the toner well, and satisfies the requirements for electric charge removal.

As the toner 7 may be used generally a so-called high resistance toner. It is preferable that a pellet type toner has a volume resistivity of about $10^{10}$ Ωcm. For example, it is preferable to use a toner prepared in such a manner that a mixture of 4 weight parts to 10 weight parts of carbon black with 80 weight parts to 90 weight parts of a base resin is kneaded, 0 weight part to 5 weight parts of an electric charge control agent and a small amount of a curing control agent are mixed therewith as appropriate, and 0.2 weight part to 2 weight parts of a post additive such as silica is added thereto after a grinding operation. The method of measuring the volume resistivity is the same as in the case of the developing roller 3, in which method, as mentioned below, two pieces of toner which is cured into a pellet form are sandwiched between electrodes and a voltage is applied thereto to measure the amperage. The voltage to be applied, which depends on the thickness of the piece, is preferably 1000 V or less in a 1 mm thick piece. As the toner 7 may be used, for example, AR-ST12-B manufactured by Sharp, which is intended for use in electrophotographic machine AR5130 manufactured by Sharp.

A sealing (not shown) may be provided in a lower portion of the developing apparatus 1*a* to prevent leakage of the toner 7. As the sealing may be used, for example, 0.1 mm thick Mylar film. Additionally, if necessary, aluminum may be vapordeposited on the sealing to give electrical conductivity and the electrically conductive surface of the sealing is made to contact with the developing roller 3, while setting the same voltage as that of the developing roller or a higher voltage than that by +50 V, to provide an effect of removing the electric charge of toner.

In the interior of the developing roller 3 occurs a voltage drop caused by an effective roller electric resistance of the developing roller 3 and an electric current which flows in the developing operation. The effective roller electric resistance is optimized to drop the developing bias voltage which effectively acts on the surface of the developing roller 3 to obtain a steep and binary-type development feature with the result that a good contrast image can be obtained.

Figure 2:
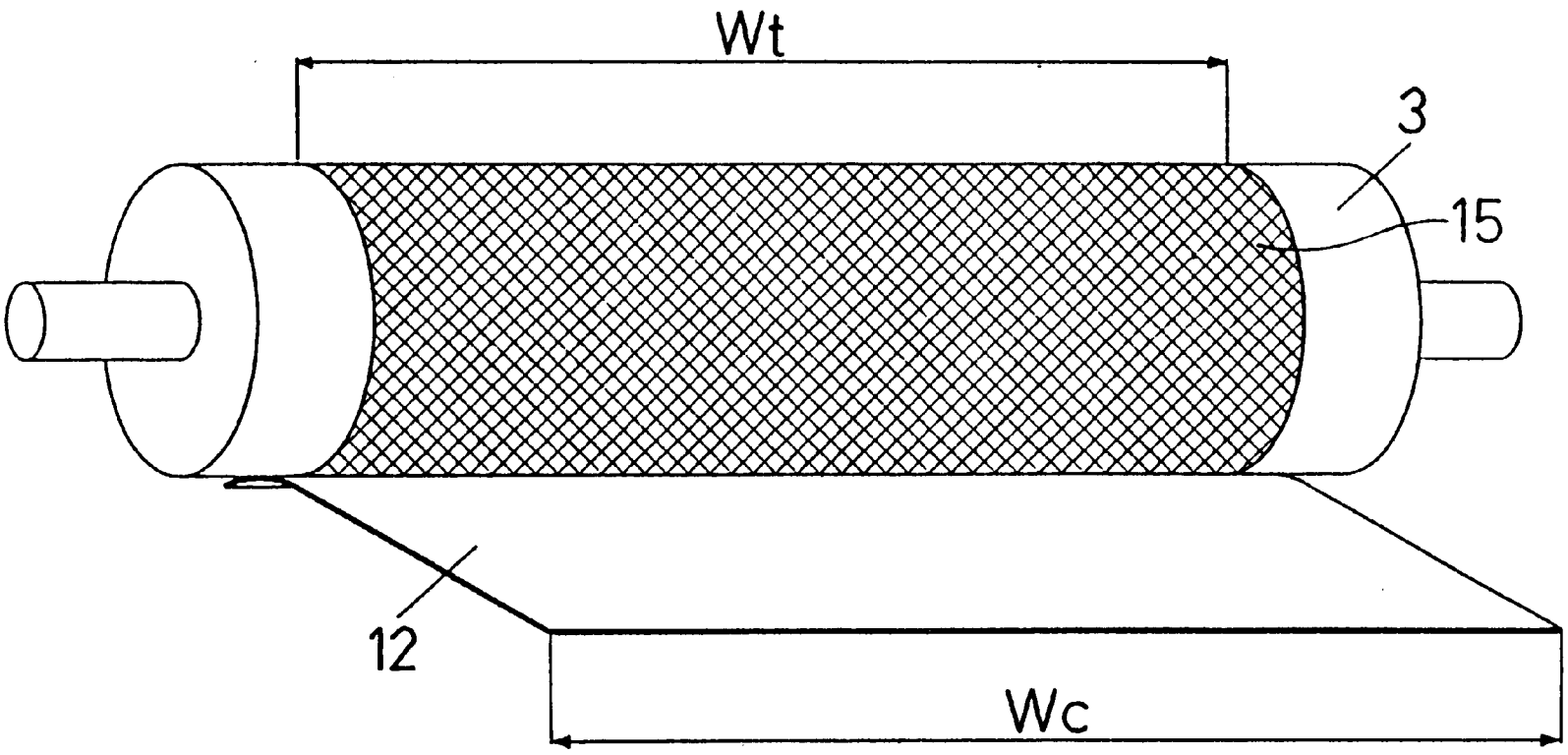
FIG. 2 is a view showing a relation between a width Wt of a toner layer 15 on a developing roller 3 in a rotating direction thereof and an effective width for electric charge removal Wc of an electric-charge-removing sheet 12.

A first feature of such developing apparatus 1*a* is that as shown in FIG. 2, a width Wt of the toner layer 15 of the toner 7 carried by the developing roller 3 in the rotating direction of the developing roller 3 and the effective width for electric charge removal Wc of the electric-charge-removing sheet 12 are set so as to satisfy the relationship of $Wc \geqq Wt$. Thereby the toner layer 15 on the developing roller 3 can be totally covered with the electric-charge-removing sheet 12 with the result that the electric charge of the toner layer 15 on the developing roller 3 after the development can be removed with reliability. Accordingly the electric charge of the toner remaining on the developing roller is prevented from becoming uneven and thereby the toner is evenly removed by the toner-supplying roller 8 as well as uniform supply of toner by the toner-supplying roller 8 can be achieved. For example, the widths Wt and Wc are set at 306 mm and 308 mm, respectively.

Figure 3:
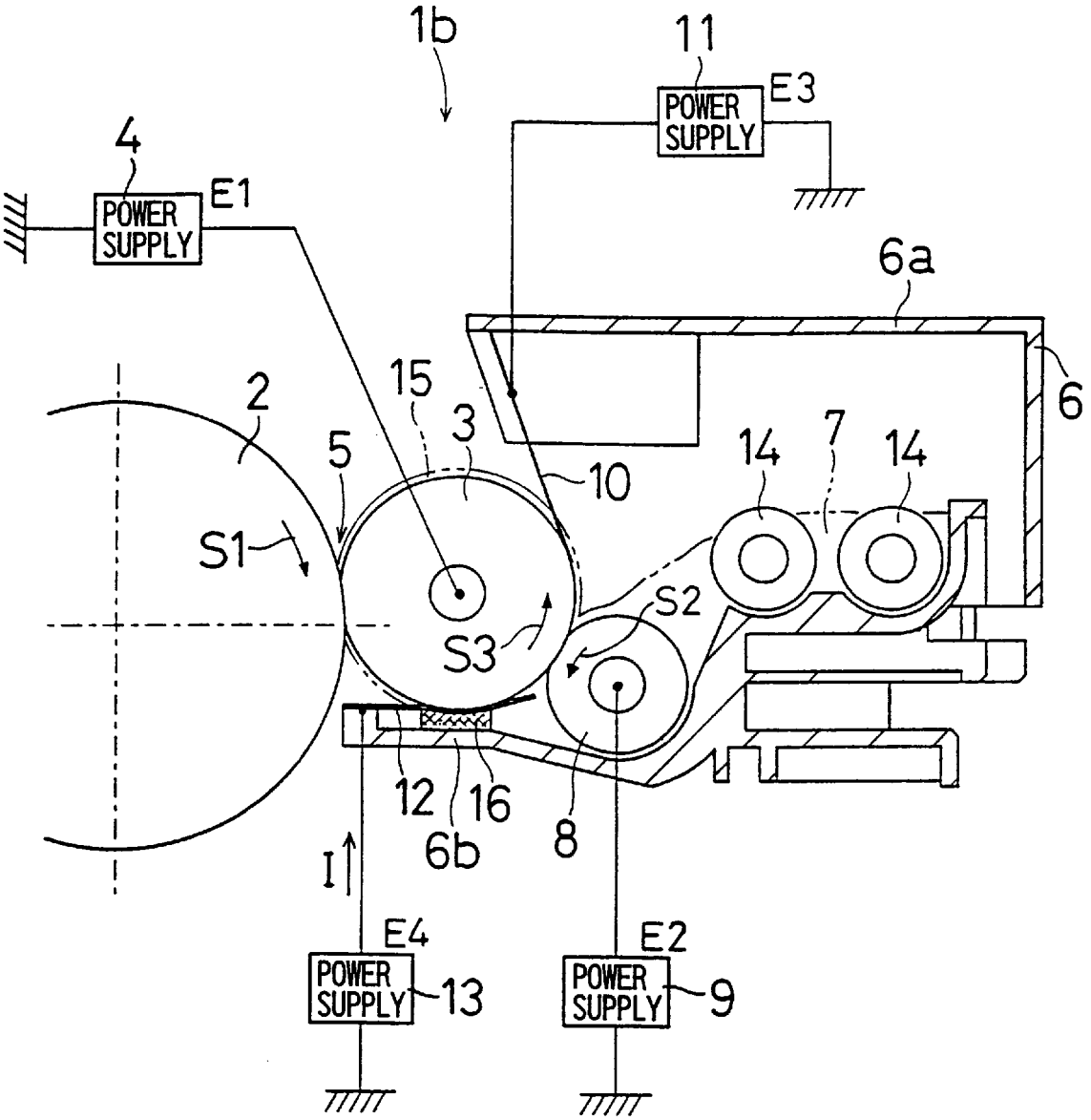
FIG. 3 is a view showing a sectional view of a developing apparatus 1*b* with an elastic member 16 of another embodiment.

A second feature is that the elastic member is provided on the side of the electric-charge-removing sheet 12 which side is opposite to the developing roller 3 side. FIG. 3 is a sectional view showing a developing apparatus 1*b* comprising an elastic member 16. The developing apparatus 1*b* has the same constitution as that of the developing apparatus 1*a* except comprising the elastic member. The elastic member 16 is inserted between the electric-charge-removing sheet 12 and a lower part 6*b* of the toner hopper 6 so as to contact therewith. The electric-charge-removing sheet 12 can be sufficiently contacted with the developing roller 3 by the elastic member 16, and accordingly the electric charge of the toner layer 15 on the developing roller 3 after development can be removed with reliability.

For example, the electric-charge-removing sheet 12 is mounted so that the electric-charge-removing sheet 12 is engaged in the developing roller 3 in a depth of about 0.5 mm and the nip between the developing roller 3 and the electric-charge-removing sheet 12 is 0.5 mm to 1 mm. Additionally the bias voltage E4 higher than that of the developing roller by +200 V is applied to the electric-charge-removing sheet 12, for example, when the predetermined bias voltage E1 is −250 V, the bias voltage E4 is −50 V.

When the elasticity of such elastic member 16 is optimized, the toner 7 is prevented from falling or splashing, and can be recovered in a toner hopper 6 without accumulation. That is, the elastic member 16 is preferably composed of a foam which is formed by foaming a dielectric material with a foaming agent. Thus, the contact area of the elastic member 16 and the developing roller 3 is certainly assured, efficiency of the electric charge removal is increased, and a load by the contact is reduced.

The aforementioned dielectric material may be one of EPDM, urethane, nylon, silicon, PET, PTFE, PVDF, natural rubber, nitrile butadiene rubber, chloroprene rubber, styrenebutadiene rubber, butadiene rubber, isoprene rubber and polynorbornene rubber. These dielectric materials are stably foamed to yield a foam readily.

The aforementioned foaming agent is preferably a nitrogen-type one, with which fine and uni-granular form is formed in the dielectric material.

It is preferable that the aforementioned dielectric material is any one of propylene oxide, ethylene oxide, polyether polyol, tolylene diisocyanate, 5-butanediol, silicon-type surface activator and dibutyltin dilaurate, or is made by chemical reaction of two or more selected therefrom. With these materials, the foaming characteristics become stable independent of temperatures in the foaming step or lots of materials. Thus, a foam having a cell density of about 80 cells/inch to 100 cells/inch can be obtained.

The aforementioned elastic member preferably contains a material regulating the electric resistance value, including conductive fine particles, carbon, $TiO_2$, and the like, which may be used alone or in combination. The electric resistance is regulated with such a regulating material to reduce the fluctuating range of the electric characteristics. Thus, the voltage required for electric charge removal can certainly be given to the electric-charge-removing sheet 12.

The second feature may be practiced in combination with the first one.

A third feature will be explained as follows, wherein the electric charge of the toner layer 15 on the developing roller 3 is removed certainly after development. In order to remove rapidly and certainly the electric charge of the toner layer 15 on the developing roller 3 through the electric-charge-removing sheet 12, the voltage E4 applied to the sheet 12 has to be transferred enough to the toner layer 15. For this purpose, the charging time for the electric-charge-removing sheet 12 has to be much smaller than the time within which a certain point of the developing roller 3 passes through the sheet 12. Assuming that the toner layer 15 is a capacitor on which surface has an electric charge, the developing apparatus 1*a* is explained as follows.

Time constant $\tau$ can be obtained from $\tau=CR$, and the relation of $C=\epsilon\epsilon_o S/d$, $R=\rho d/S$ provides $\tau=CR=(\epsilon\epsilon_o S/d)\cdot(\rho d/S)=\epsilon\epsilon_o\rho$, $\epsilon$ is a dielectric constant of the electric-charge-removing sheet 12, $\epsilon_o$ is a permittivity in vacuo, S is a unit area of the sheet 12, d is thickness of the sheet 12, and $\rho$ is a volume resistivity of the sheet 12. In such a condition as the contact length between the developing roller 3 and the electric-charge-removing sheet 12 is made L, the rotation speed of the developing roller 3 is made $v_t$, and $\tau$ is fixed to the same as the passing-time $t=L/v_t$, sufficient electric-charge-removing effect cannot be obtained because of nip change due to the rotation speed of the developing roller 3, change of the contact width due to the elasticity changing dependent on environmental temperatures, and change of electric resistance. Accordingly, it is preferred to satisfy $\epsilon\epsilon_o\rho<t$, namely, $L>v_t\epsilon\epsilon_o\rho$.

The electric potential of the toner layer 15 and change of the concentration or disappearance of double exposure, i.e., ghost, caused by the electrical background remaining in the developing roller 3 or the toner 7 were examined depending on an passing-time t. The results are shown in Table 1. Immediately after passing through the developing area and at $\epsilon\epsilon_o\rho$=t, 2t and 5t, ghost could not be eliminated, but at $\epsilon\epsilon_o\rho$=10t it disappeared.

TABLE 1

| | Immediate after development | $\epsilon\epsilon_0\rho$ = t | $\epsilon\epsilon_0\rho$ = 2t | $\epsilon\epsilon_0\rho$ = 5t | $\epsilon\epsilon_0\rho$ = 10t |
|---|---|---|---|---|---|
| Electric potential of toner layer | −100 V | −94 V | −80 V | −40 V | −5 V |
| Ghost disappearance | X | X | X | Δ | ○ |

X: no disappearance; Δ: partially disappeared; ○: disappeared

Accordingly, it is preferred to satisfy $L \geqq 10 v_t \epsilon\epsilon_o \rho$. For example, a condition of $L=2\times10^{-3}$ m, $v_t=280\times10^{-3}$ m/s, $\epsilon=15$, $\epsilon_o=8.854\times10^{-12}$ F/M, and $\rho=2\times10^6$ Ωcm affords $10\ v_t\epsilon\epsilon_o\rho=7.43736\times10^{-4}$. Thus, the above relationship is satisfied.

In the developing apparatus 1*b*, a combined dielectric constant $\epsilon_s$ between the electric-charge-removing sheet 12 and the elastic member 16 may be used in place of $\epsilon$, and a combined volume resistivity $\rho_s$ may used in place of $\rho$. In such a situation, it is preferred to satisfy the relation of $\epsilon_s\epsilon_o\rho_s<t$, particularly $L \geqq 10\ v_t\epsilon_s\epsilon_o\rho_s$.

For example, when the electric-charge-removing sheet 12 and the elastic member 16 are made from resin materials, the electric characteristics, particularly the electric resistance values sometimes markedly change depending on the applied voltage or such an environment as low humidity. When the relationship of $L \geqq 10\ v_t\epsilon\epsilon_o\rho$ or $L \geqq 10\ v_t\epsilon_s\epsilon_o\rho_s$ is satisfied, the developing roller 3 certainly contacts with the electric-charge-removing sheet 12 to stabilize and remove the electric charge of the toner layer 15 on the developing roller 3.

The third feature may further be practiced in combination with any one or more of the first and second features.

A fourth feature is explained as follows. When all of the toner 7 on the developing roller 3 is exhausted, the roller 3 comes into direct contact with the electric-charge-removing sheet 12 to induce a leak of electric current. When the toner 7 is remaining on the developing roller 3, the voltage is maintained with the combined resistance of the resistance Rt of the toner layer and the resistance Rd of the sheet 12. When the resistance Rd of the sheet 12 is large, there is no potential difference due to elevation of the electric potential. Accordingly, the electric resistance Rd of the electric-charge-removing sheet 12 is preferably determined to be approximately the same as the resistance Rt of the toner layer 15 in order to remove rapidly the electric charge of the toner layer 15.

For example, when the electric resistance Rt of the toner layer 15 is $10^6$ Ω and the resistance Rd of the electric-charge-removing sheet 12 is $10^6$ Ω, there occurs no leak even in direct contact of the developing roller 3 with the sheet 12, and the voltage is maintained sufficiently. In this situation, the amount of the toner adhered is 0.8 mg/cm$^2$, Rt corresponds to the value in the application of 50 V, the thickness of the sheet 12 is 0.3 mm, and the nip between the developing roller 3 and the sheet 12 is 2 mm.

The fourth feature may further be practiced in combination with any one or more of the first—third features.

A fifth feature is explained as follows. The fifth feature comprises determining the electric-charge-removing current I in consideration of the change in quantity of the electric charge generated in the development process. That is, the current I required for electric charge removal may preferably be represented by a relationship: $I \geqq -(m/a)\cdot(q/m+\Delta q/m)\cdot v_t\cdot Wc$, wherein m/a means the toner mass per area of the toner layer 15 on the developing roller 3 after passing through the charging plate, q/m means the quantity of electric charge of the toner, Δq/m is the quantity of the change of the toner layer 15 on the developing roller 3 after passing through the developing area 5, i.e., the quantity of electric charge of the toner changed by contact with the photoreceptor drum 2 under pressure, Vt is the rotation speed of the developing roller 3, and Wc means the effective width for electric charge removal of the electric-charge-removing sheet 12. Thus, the electric charge of the toner layer 15 on the developing roller 3 can be removed certainly.

Practically, the toner layer on the developing roller 3 has the electric charge of $(m/a)\times(q/m)=q/a$. The toner layer 15 delivered with the developing roller 3 in a unit time can be considered as an electric current; the toner layer current It may be indicated by an equation $It=(q/a)\times v_t\times Wc=q\ v_tWc/a$. When an opposite polar current is supplied to the toner layer 15, the electric charge of the toner can be cancelled theoretically. It is noteworthy that the contact of the toner layer 15 to the photoreceptor drum 2 under pressure may alter the electric charge of the toner layer 15. In view of such change of the electric charge, Δq/a has to be added giving an equation: $It=(q+\Delta q)\ v_tWc/a$, representing the minimum amount of electric current.

The above relation as the fifth feature is satisfied, for example, by the following conditions. I=100 μA; the toner mass adhered to the developing roller 3 after passing through the charging plate 10, m=212.42 mg; the surface area of the developing roller 3, a=326.8 cm$^2$; m/a=0.65 mg/cm$^2$; the quantity of electric charge possessed by the toner particles, $q=10^{-15}$ C/particle; q/m=−12 μC/g; Δq/m=−3 μC/g; $v_t$=260 mm/s; Wc=306 mm. Thus, sufficient electric charge removal can be attained at the toner electric current It=10 μA to 20 μA.

The rotation speed of the developing roller is 260 mm/s; the toner-supplying roller 8 keeps in contact with the developing roller 3 by the depth of 1 mm. As for the electric-charge-removing sheet 12, the aforementioned Bayer AS-A film is used. The sheet 12 is nipped in the developing roller 3 by about 0.5 mm to keep the nip between the roller 3 and the sheet 12 at 0.5 mm–1 mm. Others are the same as in the developing apparatus 1*a*.

The minimum electric-charge-removing current I experimentally corresponds to the half of the electric charge of the toner layer, and so it is particularly preferred to satisfy $0.5 \leqq -I/((m/a)\cdot(q/m+\Delta q/m)\cdot v_t\cdot Wc) \leqq 10$. That is, the amount of the toner adhered changes in a range of 0.6 mg/cm$^2$–1.3 mg/cm$^2$ for the initially fixed value 1 mg/cm$^2$. The toner electric charge q/m changes in a range of −7 μC/g to −20 μC/g for the initial value −10 μC/g. The surface resistance value also changes depending on temperature or humidity. The above range may be established in considering these changes. Thus, undesirable change of the amount of the supplied toner caused by extremely low electric-charge-removing current as well as an electric charge leak to the developing roller caused by excess electric-charge-removing current can be prevented. Thus, stable electric charge-removal and development can be attained.

The electric-charge-removing sheet 12 may preferably be those prepared by applying conductive fine particles to plate members comprising an elastic resin. For example, they include aluminum-vapor-deposited Mylar, carbon-dispersing fluorine-type coating material, and the like. In this operation, it becomes possible that the surface has conductivity, no unsuccessful dispersion or change of hardness is observed, and the elasticity is compatible with the electric characteristic. Such an operation is effective in case of the relatively short life of the developing apparatus.

The power source 13 for the electric-charge-removing sheet may preferably be equipped with a current limiter. This works to prevent troubles of the power source 13 caused by leak of electric current even in occurrence of defects or discharge short. Thus, stable electric charge removal can be attained.

The fifth feature may further be practiced in combination with any one or more of the first—fourth features.

A sixth feature is explained as follows. In determining the voltage to be applied in consideration of the electric resistance values of the developing roller 3, the electric-charge-removing sheet 12 and the toner layer 15, it is appropriate to apply the potential difference (Vd−Vr) satisfying the following relationship in view of the relation of V=IR in order to practice supply of the electric-charge-removing current with a constant-voltage power source 13: $(Vd-Vr) \geqq -(((m/a)\cdot(q/m+\Delta q/m)\cdot v_t\cdot Wc)\cdot(Rd+Rt+Rr))$; wherein Vd is the DC voltage applied from the power source 13 for the electric-charge-removing sheet to the sheet 12, Vr is the DC voltage applied from the power source 4 for the developing roller to the roller 3, Rd is the electric resistance value of the electric-charge-removing sheet, Rt is the electric resistance value of the toner layer 15, and Rr is the electric resistance value of the developing roller 3. This relation can be applied in case of neglecting the resistant component of the toner. The power source 13 serves to apply the voltage Vd as a bias voltage E4, and the power source 4 applies the voltage Vr as a bias voltage E1.

For example, the above relationship is satisfied by: Vd=−200 V; Vr=−250 V; $m/a=0.65$ mg/cm$^2$; $q/m=-12$ $\mu$C/g; $\Delta q/m=-3$ $\mu$C/g; $v_t=280$ mm/s; Wc=306 mm, Rd=$10^4$ Ω; Rt=$10^6$ Ω; and Rr=$10^5$ Ω. For example, the developing roller 3 may be made of a high molecular material and conductive fine particles, and the electric-charge-removing sheet 12 may be made from a resin material. Even in such a case, the voltage to be applied is determined in consideration of more precise resistance value in the roller 3 and the sheet 12, and so the electric charge of the toner layer 15 on the roller 3 can be removed surely.

Particularly, in determining the maximum voltage to be applied, it is appropriate to apply the potential difference (Vd−Vr) satisfying a relationship of $$\frac{(Vd-Vr)+Vt}{dt+dr+dd} < 36\times 10^6 \quad [V/m],$$

wherein the dierectric breakdown strength of a dielectric in a perfect insulating material is $36\times10^6$ (V/m), Vt is the voltage of the toner layer 15 on the developing roller 3 after passing through the developing area, dt is the thickness of the toner layer 15, dr is the thickness of the developing roller 3, and dd is the thickness of the electric-charge-removing sheet 12. Thus, the electric potential is established in a range lower than the electric field strength of breakdown of the toner, and so stable electric charge removal can be attained.

More particularly, it is appropriate to apply the potential difference (Vd−Vr) satisfying a relationship of $$\frac{(Vd-Vr)+Vt}{dt+dr+dd} < 3\times 10^6 \quad [V/m].$$

This is suitable for use of pulverized toner. Since the pulverized toner is smaller than pellet toner, the voltage to be applied can be determined taking the thickness of air-containing toner layer in consideration, and so stable electric charge removal can be attained. For example, the above two relationships are satisfied when Vd=−200 V, Vr=−250 V, Vt=−10 to 100 V, dt=$20\times10^{-3}$ mm, dr=8 mm, and dd=0.3 mm are established.

Moreover, the toner preferably contains one or more of silica, $TiO_2$ and magnetite as an external additive. By this additive, the surface of the electric-charge-removing sheet 12 can be polished suitably, and the toner particles are easily slipped each other, the contact area between the toner particles becomes small to enhance the electric charge removal efficiency. For example, it is appropriate to add 0.5–1.8 weight parts of the external additive for 100 weight parts of the toner.

Figure 4A:
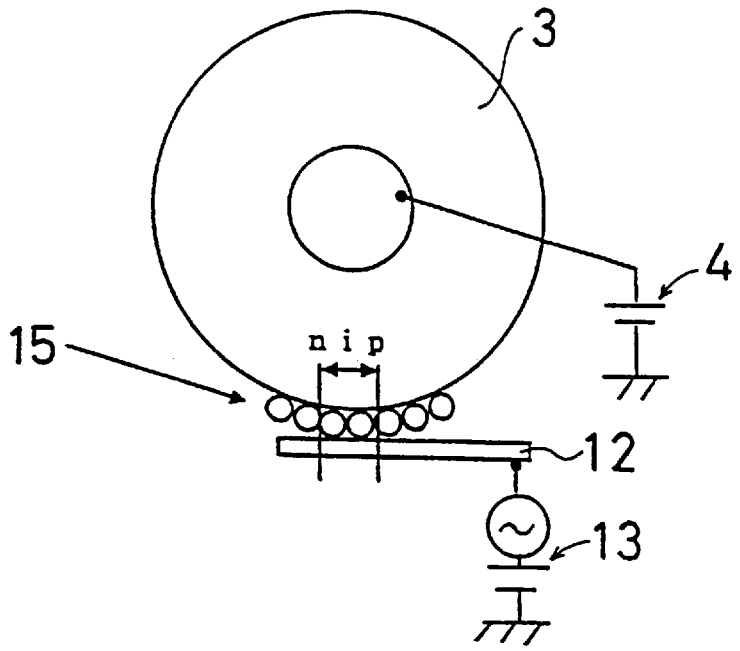
FIG. 4A is a view showing a contact portion of the developing roller 3 with the electric-charge-removing sheet 12.
Figure 4B:
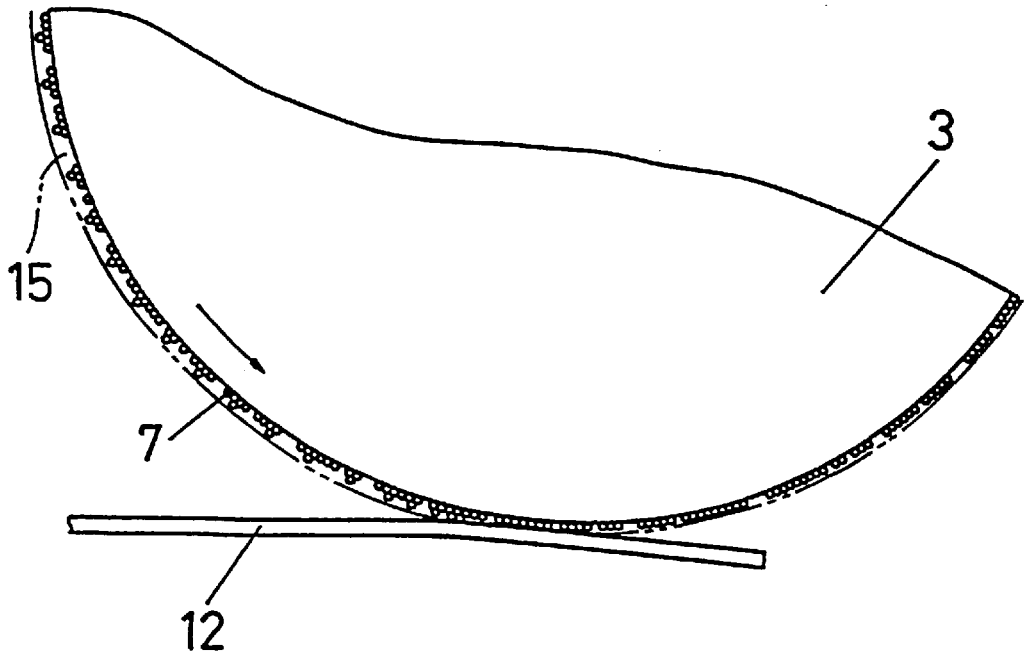
FIG. 4B is an enlarged view showing the contact portion in FIG. 4A, FIGS. 5A to 5C are views showing the contact portion under rotation of the developing roller 3 in detail.
Figure 5A:
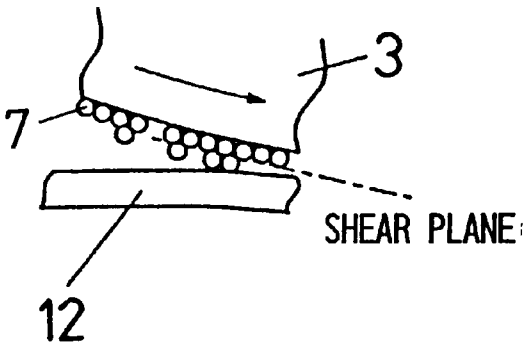
Figure 5B:
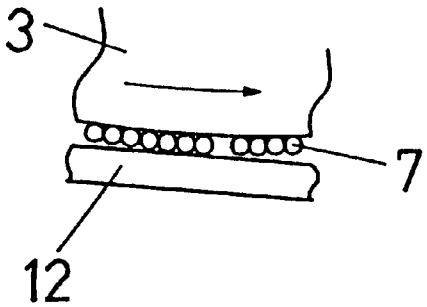
Figure 5C:
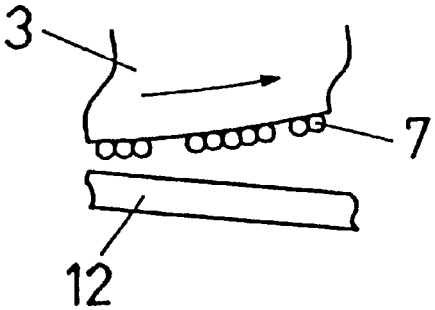

The followings are explanation of a seventh feature of the invention. The seventh feature resides in establishing the condition for certainly recovering the toner 7 of the toner layer 15 on the roller 3 after development. FIG. 4A is a view showing the contact portion of the developing roller 3 with the electric-charge-removing sheet 12, and FIG. 4B is a magnified view thereof. FIGS. 5A to 5C are views showing the contact portion accompanied by rotation of the developing roller 3 in detail. The toner layer 15 on the developing roller 3 is retained as shown in FIGS. 4A and 4B, on the surface of which a frictional electric charge is retained. When the multilayer toner 7 is caught between the electric-charge-removing sheet 12 and the developing roller 3 as shown in FIG. 5A, in order to increase the contact of the electric-charge-removing sheet with the toner 7, it is appropriate for all of the toner 7 to contact with the electric-charge-removing sheet 12, making a gap in the lamination layer as shown in FIG. 5B, and leaving from the electric-charge-removing sheet 12 as shown in FIG. 5C. For this purpose, the internal friction coefficient of the toner has to be smaller than that between the toner 7 and the developing roller 3 and between the toner 7 and the electric-charge-removing sheet 12. Moreover, it is preferred that the friction coefficient between the toner 7 and the developing roller 3 is larger than that between the toner 7 and the electric-charge-removing sheet 12 after electric charge removal, in order to prevent congestion of the toner moving from the developing roller 3 to the electric-charge-removing sheet 12.

That is, it is appropriate to establish $\mu dt<\mu t<\mu rt$ in the relationship between the internal friction coefficient $\mu t$, the friction coefficient $\mu rt$ of the toner 7 to the developing roller 3, and the friction coefficient $\mu dt$ of the toner 7 to the electric-charge-removing sheet 12. In this relationship, the toner 7 can be recovered without staying at the upper stream side of rotation direction of the developing roller in the electric-charge-removing sheet 12; thus, stable electric charge removal can be attained.

The internal friction coefficient $\mu t$ of the toner could be adjusted within the range of 0.45–0.60 as a result of measurement of the respective friction coefficients $\mu t$, $\mu rt$ and $\mu dt$. Further, it was also possible to adjust the friction coefficient ($\mu rt$, $\mu dt$) of the toner to the charging plate 10 or the electric-charge-removing sheet 12 such as phosphorus bronze, aluminum, aluminum oxide, and the like in a range of 0.48–0.63. Adjustment of the friction coefficient can be attained by making the amount of hydrophobic silica to be added 0.2–2.0 weight parts for 1 weight part of the toner. In order to decrease the friction coefficient of the toner, it is suitable to add 0.01–1.0 weight part of a fatty acid-type material such as zinc stearate or calcium stearate for 1 weight part of the toner. For example, $\mu t=0.45$, $\mu rt=0.57$ and $\mu dt=0.63$ are preferred.

The toner 7 was recovered most efficiently when the electric-charge-removing sheet 12 was made from 0.7–1.2 weight parts of silica and AS-A film, the developing roller 3 was made by dispersing carbon into polyurethane resin, and the surface roughness of the roller 3 was made to 3 $\mu$m–5 $\mu$m by grinding. In this condition, the developing roller 3 had a strong delivery power and the toner 7 slipped sufficiently on the electric-charge-removing sheet 12.

Moreover, when a relatively large amount of the toner 7 is intended to retain on the developing roller 3, the electric-charge-removing sheet 12 has to be made from rubber to reduce the contact pressure. With respect to the adhesive property of the electric-charge-removing sheet 12, it should be formed with a rubber material since such a highly wetting material as resin materials cannot be fixed firmly to the toner hopper 6. Such a rubber material, however, has a large friction coefficient though the surface roughness can be made fine. Therefore, it is appropriate to apply a resin material on the surface of the electric-charge-removing sheet 12 at the developing roller side so as to be $\mu dt<\mu t$ in order to recover completely the toner 7 remaining on the developing roller 3 after development. In this condition, the toner 7 can be recovered without staying at the upper stream side of rotation direction of the developing roller in the electric-charge-removing sheet 12; thus, stable electric charge removal can be attained. The resin material to be applied on the surface of the electric-charge-removing sheet 12 at the developing roller side includes preferably fluorine-type or fluorine-containing resins which are high in insulation, low in frictional resistance, and high in heat resistance. Application of such a resin scarcely produces peeling-off due to wear or friction heat.

In using a silicon rubber or urethane rubber of which the friction coefficient is adjusted with dispersion of carbon black so that the surface roughness is approximately equal to the toner particle size, the developing operation cannot be achieved smoothly since an obstacle is produced to prevent the toner from removing. Moreover, the qualities of the image decrease due to splashing or falling of the toner, or the lifetime of the apparatus is reduced due to soiling of the inside. Accordingly, it is particularly preferred to make the roughness of the contact portion between the electric-charge-removing sheet 12 and the developing roller 3 smaller than the toner particle size. For example, the roughness is made into ½ or less of the toner particle size, practically selected in a range of 1/50–½ of the particle size. In this operation, the obstacle of the electric-charge-removing sheet 12 is eliminated for the toner 7 to easily slip; thus, the toner 7 can easily be recovered.

In the electric-charge-removing process for the toner layer 15 on the developing roller 3 after the developing process, a leak of an electric current occurs from the ends of the developing roller 3 in the case that electric resistance in the electric-charge-removing sheet 12 is low. The reason is that the developing roller 3 comes into direct contact with the electric-charge-removing sheet 12; therefore, when the toner layer 15 is formed on the developing roller 3, no leak of the current generates, and the electric charge removal on the undeveloped toner layer 15 can be attained. As an electric feature for the electric charge removal, the electric-charge-removing sheet 12 preferably retains electric resistance by which the electric-charge-removing electric potential is maintained even though the developing roller 3 comes into contact with the electric-charge-removing sheet 12 during contact of the developing roller 3 passing through the electric-charge-removing sheet 12. Namely, it is appropriate to make the electric resistance of the electric-charge-removing sheet 12 smaller that that of the toner layer 15 on the developing roller 3. Practically, the electric resistance of the electric-charge-removing sheet 12 is preferably fixed in a range of $1\times10^{-5}$ Ω to $1\times10^{6}$ Ω. In this operation, the electric charge removal is compatible with the voltage maintenance and the electric charge of the toner layer 15 is rapidly removed with the electric-charge-removing sheet 12 of which the electric resistance is smaller than that of the toner layer 15.

Practically, the electric charge removal can be made compatible with the voltage maintenance by fixing the electric resistance of the toner layer 15 of m/a=0.8 mg/cm$^2$ to about $10^6$ Ω at the application of 50 V, the nip between the electric-charge-removing sheet 12 of 0.3 mm in thickness and the developing roller to 2 mm, and the volume resistivity of the electric-charge-removing sheet 12 in a range of about $10^6$ Ω to $10^8$ Ω. In this situation, satisfaction of $\epsilon\epsilon_o\rho<t$ enables sufficient supply of the electric-charge-removing electric current to the toner layer 15 passed through the electric charge-removal sheet 12. For example, a sufficient electric-charge-removing effect can be attained in such a condition as the passing time t is about $7.7\times10^{-3}$s and $\epsilon\epsilon_o\rho$ is about $10^{-4}$s when used the electric-charge-removing sheet 12 of which the thickness is 0.3 mm, the electric resistance $10^3$ Ω, and the dielectric constant $\epsilon$ 15, and in which the nip with the developing roller 3 is 2 mm and the rotation speed of the roller 3 is 260 mm/s.

Particularly, the electric-charge-removing sheet 12 is preferably made of a metal material. Thus, the electric charge on the toner surface is rapidly and certainly attenuated. As for the metal material, those of approximately $10^{-5}$ Ω electric resistance and 0.1 mm in thickness, including phosphorus bronze and rolling steel sheet such as SUS304 and SUS420, are preferred.

Figure 6A:
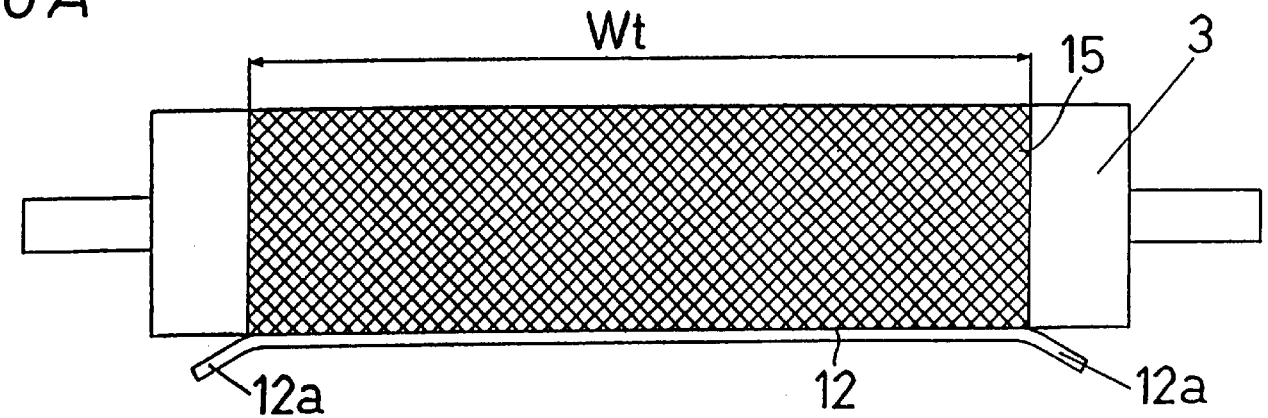
FIG. 6A is a view showing a bent portion 12*a* provided at both ends of the electric-charge-removing sheet 12.
Figure 6B:
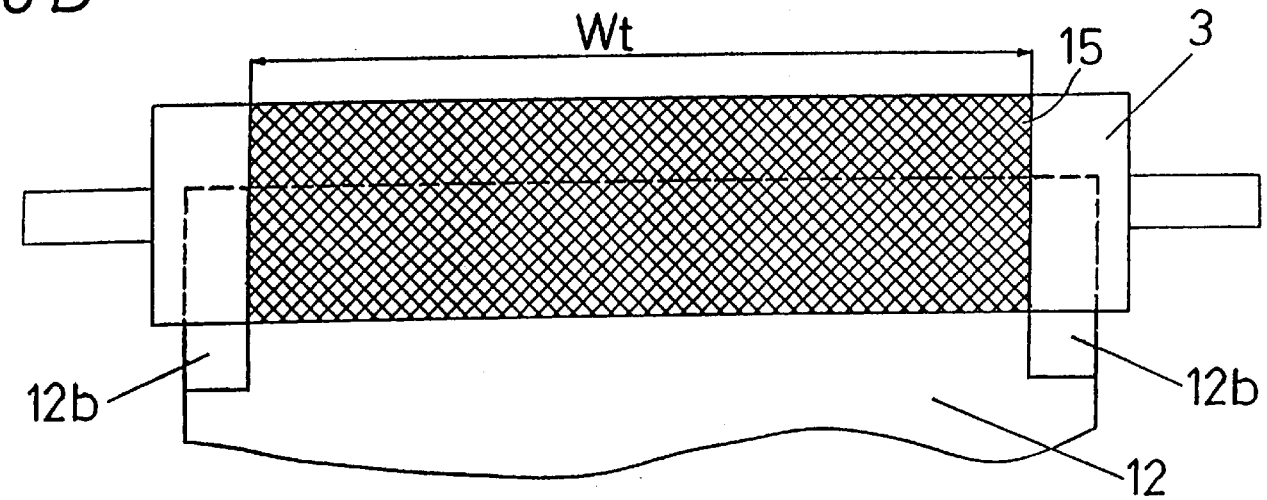
FIG. 6B is a view showing an electric insulating portion 12*b* provided at both ends of the electric-charge-removing sheet 12.

In order to avoid direct contact of the electric-charge-removing sheet 12 to the developing roller 3, it is preferred to satisfy $Wc\leqq Wt$; however, when a design of the apparatus requires $Wc>Wt$, the edge of the electric-charge-removing sheet 12 necessarily comes into direct contact with the developing roller 3. In this case, as shown in FIG. 6A, it is preferred to make a bending portion 12*a* at both terminals of the electric-charge-removing sheet 12. For example, the edge of 0.03 mm–0.1 mm in length is slightly bent in the direction apart from the rotary shaft. Alternatively, instead of making the bending portion 12*a*, as shown in FIG. 6B, an electric resistance portion 12*b* may be disposed at both terminals of the electric-charge-removing sheet 12. For example, an insulating material such as fluorine-type resin may practically be applied to the terminals. Alternatively, an insulating tape such as Teflon may practically be stuck. As for the insulating tape, for example, Teflon tape Scotch (3M) and Nitoflon tape No. 903UL (Nitto Electric Industrial Co.) are preferred. In this situation, a leak between the developing roller 3 and the electric-charge-removing sheet 12 can be prevented, and stable development can be attained. Particularly, when a fluorine-type resin is applied, the frictional resistance becomes small to prevent peeling-off and noisy sounds in the electric-charge-removing sheet 12.

Figure 7A:
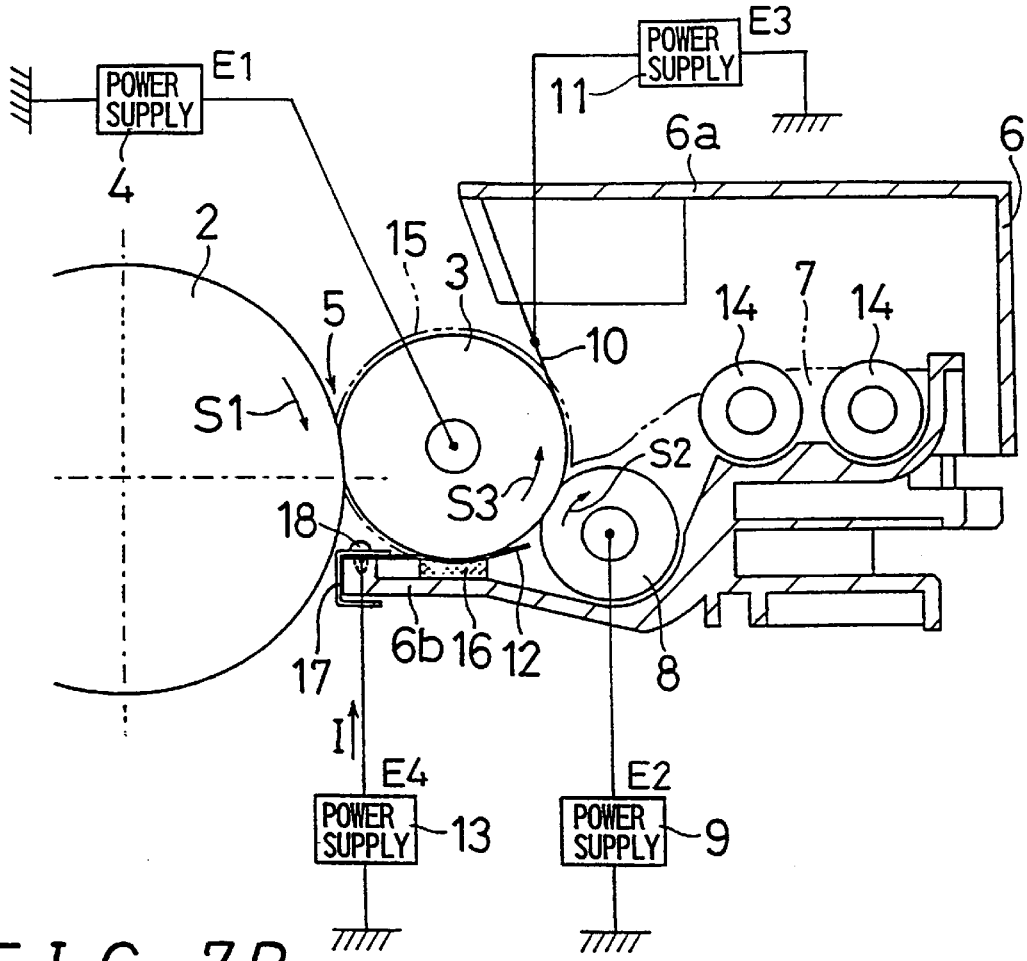
FIG. 7A is a view showing a sectional view of a developing apparatus provided with the electric-charge-removing sheet 12 fixed by a connecting member 17 and a screw member 18.
Figure 7B:
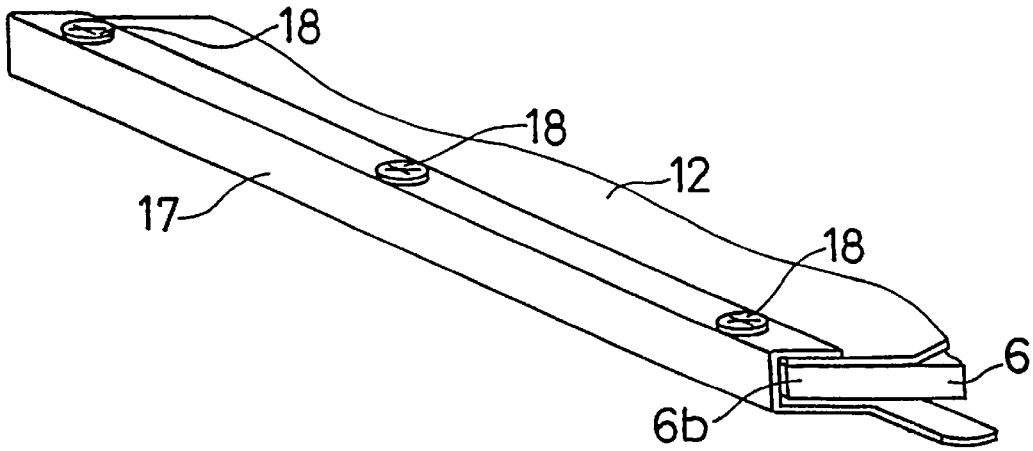
FIG. 7B is an enlarged perspective view showing the electric-charge-removing sheet 12 which is fixed at a lower part 6*b* of a toner hopper 6 using the connecting member 17 and the screw member 18.

The electric-charge-removing sheet 12, as shown in FIGS. 7A and 7B, may preferably be fixed at the lower part 6B of the tone hopper 6 with a connecting member 17 and a screw member 18. The connecting member is made of a metal, with which the electric-charge-removing sheet 12 is held at the lower part 6*b* of the toner hopper 6 and fixed with the screw member 18. In this operation, when the sheet 12 penetrates 0.5 mm–1 mm into the developing roller 3, the contact between the roller 3 and the electric-charge-removing sheet 12 becomes more stable than that in a condition in which the toner hopper 6 expands and contracts depending on an environmental change such as temperature or humidity or a two-sided tape of weak adhesion is applied. Accordingly, the stable electric charge removal can be achieved. Particularly, the connecting member 17 is preferably used as a terminal for voltage application to the electric-charge-removing sheet 12. In this situation, the application of voltage can be carried out with no influence of slipping of or contamination with the toner 7; thus, the stable electric charge removal can be achieved.

The seventh feature may further be practiced in combination with any one or more of the first—sixth features.

The followings are an explanation of the eighth feature of the invention. The eighth feature is that the developing apparatus has a constitution similar to that of the developing apparatus 1*a* as shown in FIG. 1 as well as a constitution similar to that of the developing apparatus 1*b* having the elastic member 16 as shown in FIG. 3, wherein the power source 13 applies an AC voltage VAC as a bias voltage E4, more specifically an AC voltage VAC in which an AC voltage is superimposed on a DC voltage, to the electric-charge-removing sheet 12. For example, the DC voltage is +200 V, and the AC voltage is 450 V as a peak-to-peak voltage Vpp.

In order to certainly remove the electric charge of the toner layer 15 on the developing roller 3, after development, with the bias voltage E4 of the DC alone via the electric-charge-removing sheet 12, the bias voltage E4 applied to the electric-charge-removing sheet 12 has to move to the toner layer to cancel the electric charge of the toner. Therefore, it is preferred that the relationship of $\epsilon\epsilon_o\rho<t$ and $L\geqq 10\ v_t\epsilon\epsilon_o\rho$ is satisfied as in the third feature.

The electric charge of the toner, however, is distributed not only to the surface but also to the inside, or distributed to the hollow of amorphous toner. In such a case, the electric charge of the toner of the direct current component cannot be removed completely with the bias voltage of the reverse polarity and electric current. Particularly, in conductive high-molecular materials, i.e., dispersible conductive materials, of which the non-conductive portion has a trap of electric charge, a sufficient effect for the electric charge removal cannot be obtained even in application of a high DC voltage.

Accordingly, in order to certainly remove the electric charge of the toner as mentioned above, an AC bias voltage VAC is preferably applied to the electric-charge-removing sheet 12. Table 2 shows the relationship among the AC bias voltage VAC applied to the electric-charge-removing sheet 12, the electric potential of the toner layer 15 and the ghost level. The AC bias voltage VAC applied to the electric-charge-removing sheet 12 is indicated by peak-to-peak voltage Vpp at the frequency of 1 kHz. The amount of the toner adhered was m/a=1 mg/cm$^2$, the amount of electric charge in the toner q/m=−20 $\mu$C/g, and the experimental environment 10° C. and 15% RH.

TABLE 2

| | Immediate after development | $V_p$ − p60 V | $V_p$ − p120 V | $V_p$ − p250 V | $V_p$ − p450 V |
|---|---|---|---|---|---|
| Electric potential of toner layer | −100 V | −80 V | −60 V | −30 V | −2 V |
| Ghost level | x | x | x | Δ | ○ |

x: unacceptable, Δ: unclear; ○: good

From Table 2, it is found that the ghost level is improved by application of 450 V or higher of AC voltage Vpp. That is, the following relationship is preferably satisfied.

$$2\times|Vd-Vr|<Vpp(VAC)2\times200<450$$

From the fourth feature, in order to rapidly remove the electric charge of the toner 15, it is appropriate to establish the electric resistance Rd of the electric-charge-removing sheet 12 at approximately the same as the electric resistance Rt of the toner layer 15. Such a situation of the electric-charge-removing sheet 12 established for the developing roller 3, however, is possible only when the sheet 12 is relatively soft in a form of sheet material, and effective when the developing roller 3 is relatively large in diameter. In recent electrophotographic technology, a process cartridge of a laser beam printer or process devices or parts of a digital PPC are miniturized, and so the developing roller becomes small in diameter. When the diameter of the developing roller 3 is made 20 mm ϕ or less, the contact area with the electric-charge-removing sheet 12 becomes small. It is difficult to optimize the contact area.

Accordingly, it is appropriate to apply an AC bias voltage VAC to the electric-charge-removing sheet 12 to increase the electric-charge-removing effect. Thus, the effective resistance value decreases, and the electric charge distributing from the surface to the inside can be removed. Table 3 shows the relation between the frequency of the applied AC voltage Vpp of 450 V satisfying the above relationship of $2\times|Vd-Vr|<Vpp$ (VAC), electric potential of the toner 15, and the ghost level. The amount of the toner adhered was m/a=1 mg/cm$^2$, the quantity of electric charge in the toner q/m=−20 $\mu$C/g, and the experimental environment 10° C. and 15% RH.

TABLE 3

| | Immediate after development (no application) | 100 Hz | 200 Hz | 500 Hz | 1 KHz |
|---|---|---|---|---|---|
| Electric potential of toner layer | −100 V | −90 V | −85 V | −50 V | −7 V |
| Ghost level | x | x | x | Δ | ○ |

x: unacceptable, Δ: unclear, ○: good

From Table 3, it is found that the ghost level is improved by fixing the frequency at 1 kHz or more in application of 450 V of AC voltage Vpp.

As demonstrated in the sixth feature, the toner may preferably contain a predetermined amount of an external additive. The bias voltage VAC applied to the electric-charge-removing sheet 12 was mentioned above, but the limit electric field becomes one order or more small depending on the external additive, its form and a rotary effect on the developing roller. Accordingly, it is preferred to determine the AC bias voltage VAC so that the effective electric field of the toner layer 15 is approximately $3\times10^6$ V/m.

Practically, the bias voltage VAC may be determined by experimentally measuring the electric resistance value of the toner layer 15 in view of such a background.

Table 4 indicates the relation among the AC voltage Vpp, the upper limit of an effective electric field of the toner layer 15, an electric potential of the toner layer 15, and the ghost level. The upper limit of an effective electric field of the toner layer 15 was obtained experimentally by applying a voltage to the toner layer to generate an electric field in which an electric discharge is initiated. The upper limit of an effective electric field of the toner layer 15 is practically obtained by dividing the voltage applied to the toner layer 15 by the thickness of the toner layer 15. The frequency was fixed at 1 kHz.

TABLE 4

| Alternating voltage applied (peak-to-peak voltage) [V] | Immediate after development | 60 | 120 | 250 | 450 |
|---|---|---|---|---|---|
| Upper limit of the effective electric field of the toner [$10^6$ V/m] | 1.18 | 1.35 | 1.53 | 1.91 | 2.50 |
| Electric potential of the toner layer [V] | −100 | −80 | −60 | −30 | −2 |
| Ghost level | x | x | x | Δ | ○ |

x: unacceptable, Δ: unclear, ○: good

From Table 4, it is found that the ghost level is improved by fixing the upper limit of an effective electric field of the toner layer 15 at approximately $3\times10^6$ V/m.

Finally, methods for determining the electric resistance value of the toner layer 15, the electric resistance value of the developing roller 3, the quantity of electric charge of the toner on the roller 3, the amount of the toner adhered and the friction coefficient will be explained as follows. The electric resistance value was determined basically according to JISK-6911. The friction coefficient was determined in reference to U.S. Pat. No. 4,656,965.

Figure 8:
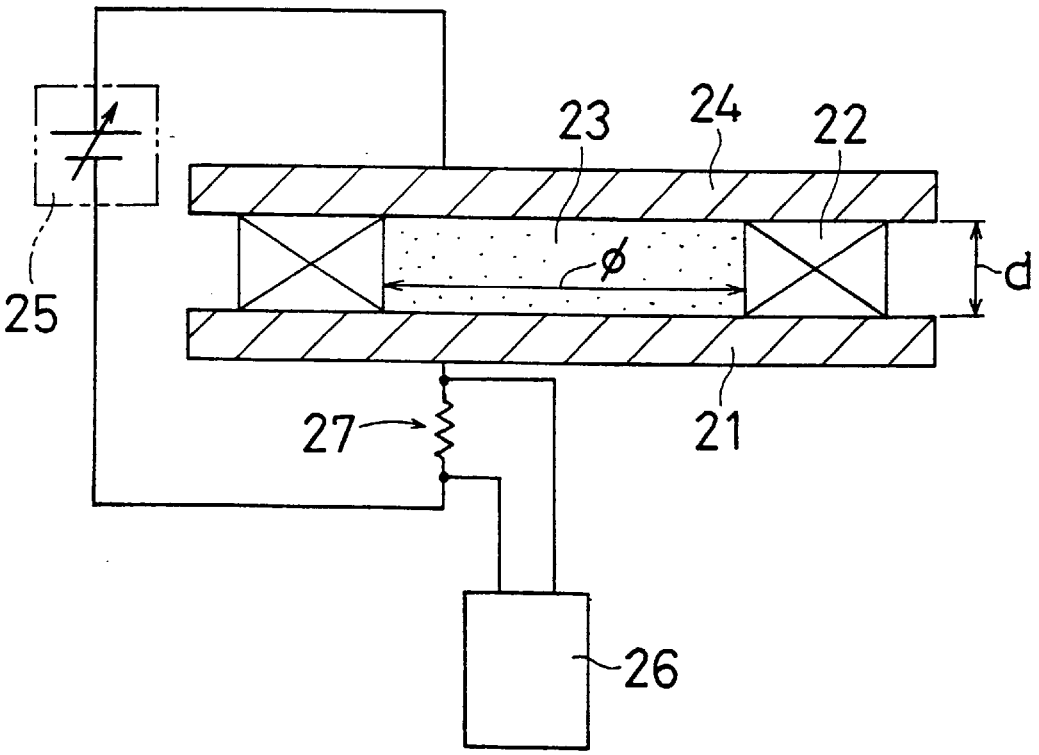
FIG. 8 is a view illustrating a method for determining a static electric resistance value of the toner layer 15.

FIG. 8 is a view explaining a method for determining the static electric resistance value of the toner layer 15. A cylinder 22 is disposed on the electrode 21 in a pair of electrodes 21 and 24 of the brass-made plate form. The cylinder 22, having a cylindrical portion of 0.5 mm in depth d and 20 mm in diameter ϕ, is made of a plastic such as polycarbonate, polyethylene, PTFE, etc. The toner 23 is placed in the cylindrical portion, the surface is properly made even to stop gaps forming pellets having the same density as the practical toner layer, and covered with another electrode 24. Between the electrodes 21 and 24 is applied voltage with a voltage power source, for example, TREK610C (TREK Co.). A resistor 27 with a resistance value R being 1–10 kΩ is disposed in series at the side of lower voltage. The voltage applied to the resistor 27 is measured with a voltmeter, e.g., FLUKE87 (FLUKE Co.) to obtain an electric current.

The electric current I obtained by application of the voltage V has the following relation: $V=IR$, $R=(\rho\cdot d)/S$, $S=2\pi r$, and then $\rho=(R\cdot S)/d$. In this relation, ρ means volume resistivity, and S is the toner contact area of the electrodes 21 and 24. In the case of $S=6.29$ cm$^2$ and $d=0.05$ cm, $\rho=1.26\times10^2\times(V/I)\Omega\cdot$cm is obtained. In practice, the effective electric resistance value is obtained from the nip in the developing area, the nip in the electric-charge-removing area and the contact width in the direction of the rotary axle of the developing roller.

The electric resistance value of the toner layer 15 in the developing apparatus 1*a* as an embodiment of the invention, which was determined according to the method illustrated in FIG. 8, was 1 MΩ–1000 MΩ. The electric resistance value of the toner layer 15 on a practically developing roller was calculated back from the thickness to be about 1–10 MΩ. This was consistent with the resistance value in the protective resistance (a ceramic resistance inserted between the bias pressure and the electric-charge-removing sheet) inserted into the electric-charge-removing sheet 12 to prevent a leak in a state with no toner layer 15 after complete filled-in development. Table 5 indicates the results for the voltage applied, the electric current I and the electric resistance value ρ of the toner layer.

TABLE 5

| Voltage applied [V] | 1 | 10 | 50 | 100 | 500 |
|---|---|---|---|---|---|
| Currency measured [A] | $10^{-9}$ | $2\times10^{-8}$ | $5\times10^{-7}$ | $5\times10^{-6}$ | $2.5\times10^{-4}$ |
| Resistance of the toner layer [Ω] | $1\times10^9$ | $5\times10^8$ | $1\times10^8$ | $2\times10^7$ | $2\times10^6$ |

The capacity of electricity in the toner layer 15 was obtained by application of an AC voltage of 10 V or 1 V, which was carried out in an electrode device of FIG. 8 of which both terminals are connected to an LCR meter.

Figure 9:
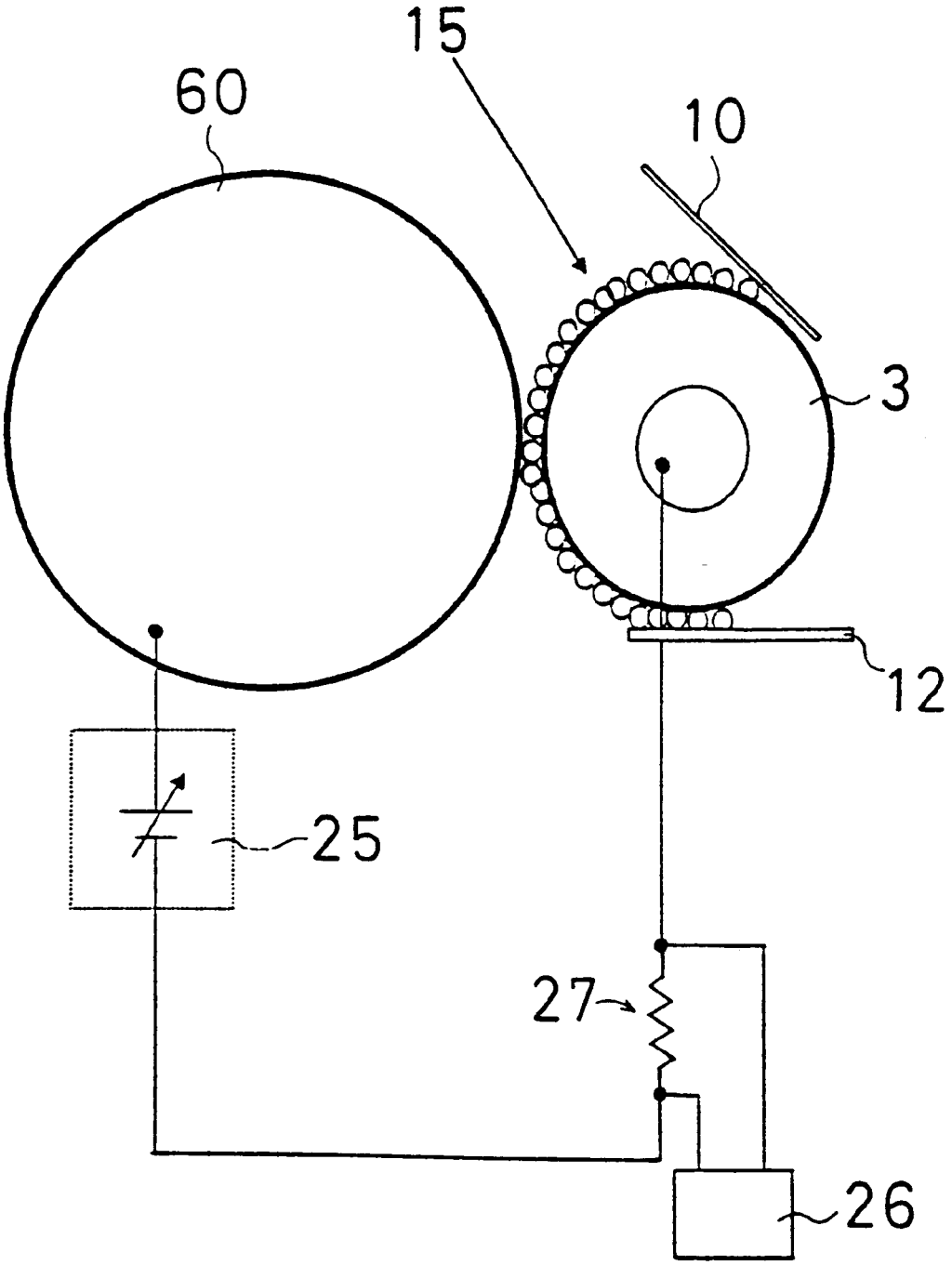
FIG. 9 is a view illustrating a method for determining a dynamic electric resistance value of the toner layer 15.

FIG. 9 is a view illustrating a method for determining the dynamic electric resistance value of the toner layer 15. The electric resistance value of the toner layer 15 formed on the developing roller 3 in an actual machine is determined using a brass-made electrode 60 which has the same curvature as the photoreceptor drum 2 used. The developing apparatus 1*a* is taken out from the actual machine, and the toner layer 15 is contacted under pressure with the drum-like electrode 60. Using the drum-like electrode 60 and the core bar as an electrode of the developing roller 3, the electric current converted into voltage is measured with a voltage power source 25, a voltmeter 26 and a resistor 27 in the same way as in measurement of the static electric resistance value. The electric resistance value of the toner layer 15 measured was about 235 MΩ when the amount of the toner adhered was about 0.6 mg/cm$^2$. In this measurement, though the developing roller 3 and the resistor 27 were connected in series, the separately measured resistance value of the roller 3 was approximately 50 kΩ–100 kΩ, which was able to neglect since it was several orders smaller than that of the toner layer 15.

Figure 10A:
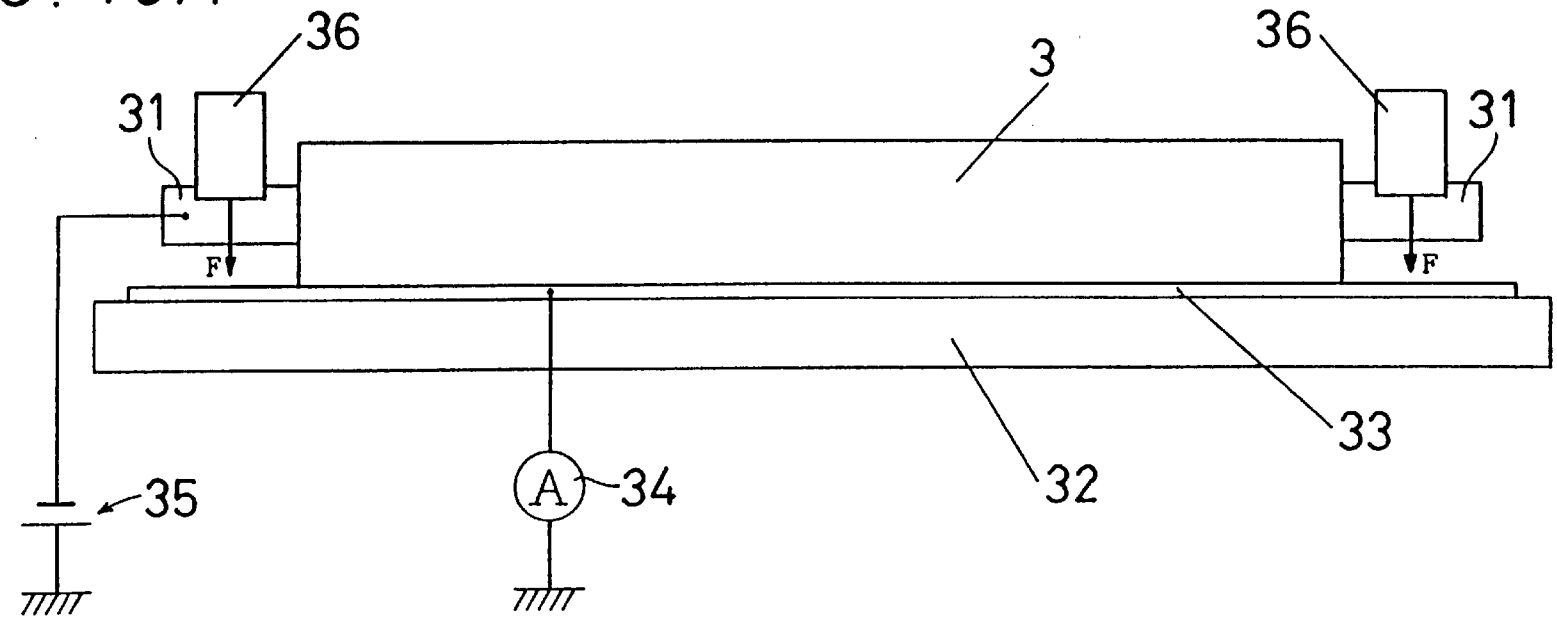
FIG. 10A is a front view illustrating a method for determining a static electric resistance value of the developing roller 3.
Figure 10B:
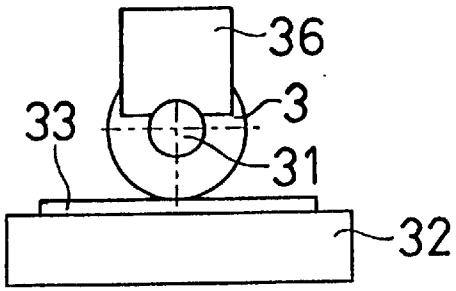
FIG. 10B is a side view thereof.

FIG. 10A is a front view illustrating a method for determining the static electric resistance value of the developing roller 3, and FIG. 10B is a side view thereof. The static electric resistance value of the roller 3 was measured as an electric current with an ampere meter 34, wherein the surface of the developing roller 3 was contacted with the electrode 33 on the base 32, a weight 36 of 100 g was placed on both ends of the rotary axle 31, a voltage of 200 V was applied from the power source 35 connected to the rotary axle 31, and the ampere meter 34 was connected to the electrode 33.

Figure 11A:
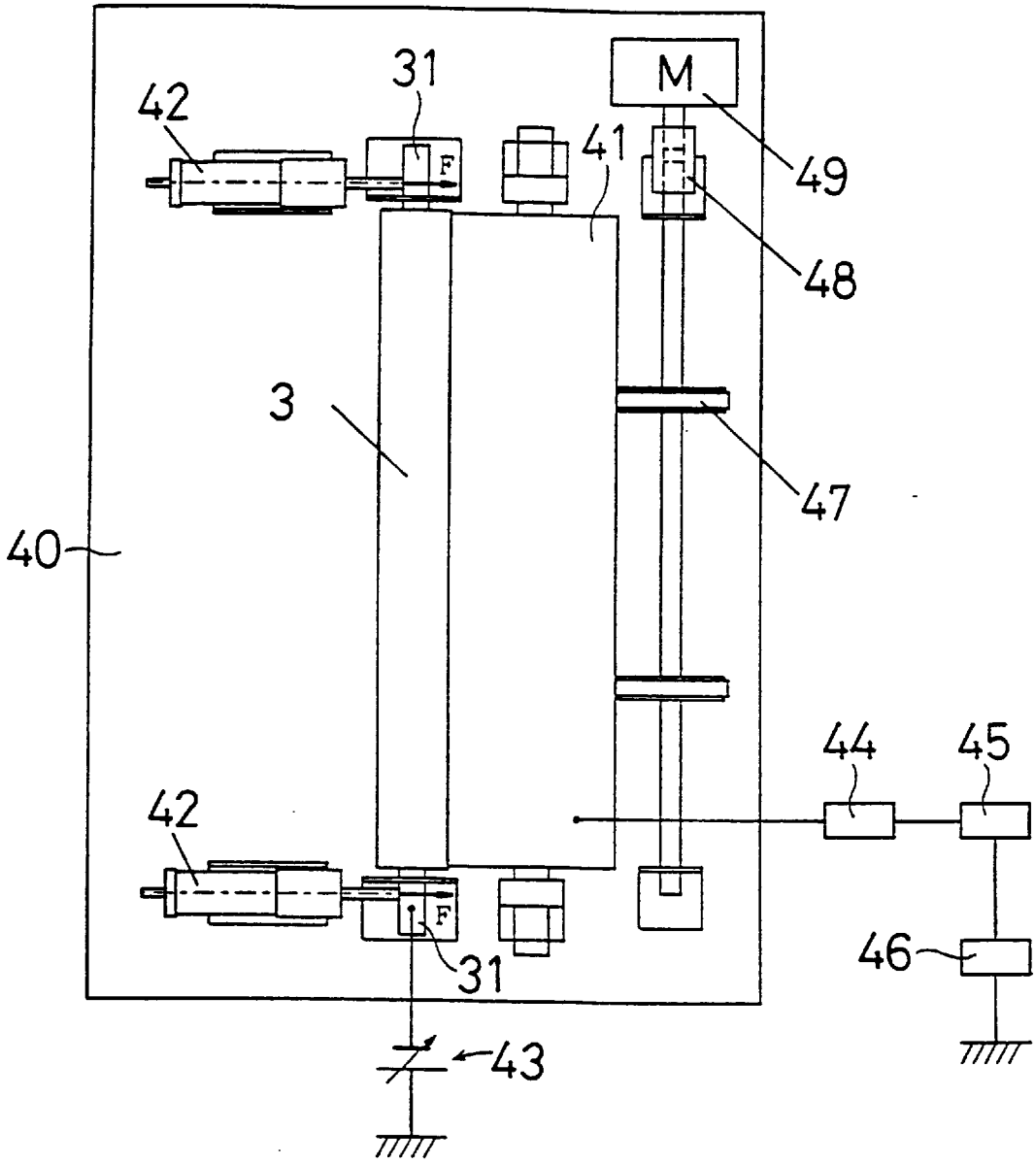
FIG. 11A is a front view illustrating a method for determining a dynamic electric resistance value of the developing roller 3.
Figure 11B:
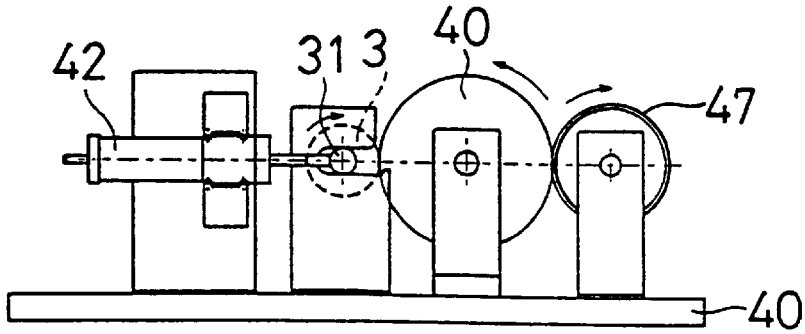
FIG. 11B is a side view thereof.

FIG. 11A is a top view illustrating a method for determining the dynamic electric resistance value of the developing roller 3, and FIG. 11B is a side view thereof. In determining the dynamic electric resistance value of the developing roller 3, a drum electrode 41 which has the same curvature radius as the photoreceptor drum 2 is disposed on a base 40 in a rotatable state, and made contact with the developing roller 3 under the same pressure as in the practical developing process with a pressurizing member 42.

The voltage applied with the power source 43 connecting to the rotary axle 31 of the developing roller 3 can be altered in strength. The drum electrode 41 is connected to a resistor 44 for measurement, of which the electric potential is measured at both ends with an isolation amplifier 45, analogue signals from which are converted into digital signals with an AD converter 46. Further, in order to reveal the actual movement, driving force of a motor 49 is transferred to the drum electrode 41 through a coupling member 48 and a roller 47 to rotate the drum electrode 41.

The developing roller 3 which was made by injection molding under heating from a dispersing mixture of carbon in polyurethane was used. The static electric resistance value was measured under application of a voltage of 10 V with no rotation of the drum electrode 41 to read as $1.83\times10^8$ Ω. The dynamic electric resistance value was measured with rotation under a voltage of 20 V to read as $8.02\times10^8$ Ω, and at 40 V to read as $1.05\times10^7$ Ω. The results indicate that the dynamic electric resistance value is larger than the static electric resistance value.

The quantity of electric charge of the toner on the developing roller 3 may be obtained as follows. The toner layer 15 formed on the developing roller 3 is sucked with a nozzle, and the weight of the toner sucked is measured based on the difference between the nozzle weights before and after sucking. Then, the electric charge equivalent to the quantity of electric charge of the toner sucked is measured with an electrometer disposed on the rotating axis of the developing roller 3. Thus, the weight of the toner sucked is divided by the whole quantity of electric charge to give the quantity of electric charge of the toner.

The amount of the toner adhered may be determined by measuring the adhered area of the sucked toner and dividing the amount of the toner sucked by the area. The adhered area may be determined using a member with a guide-channel, which is pressed against the developing roller 3 to suck the toner taken in the guide-channel area.

Figure 12:
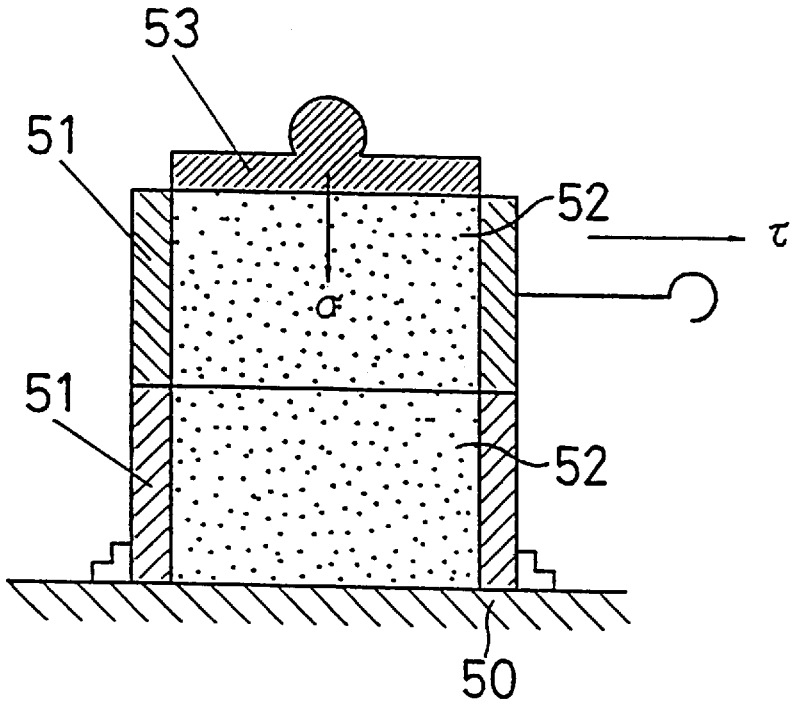
FIG. 12 is a sectional view illustrating a method for determining an internal friction coefficient $\mu t$ of the toner.

FIG. 12 is a sectional view illustrating a method for determining the internal friction coefficient $\mu t$ of the toner. A cylinder 51 is fixed on a base 50, and toner 52 is placed in a cylindrical portion, on which another cylinder 51 containing toner 52 in its cylindrical portion is placed. A weight 53 is further placed thereon. A force required for pulling the upper cylinder 51 transversely is measured. On the other hand, a force when the upper cylinder 51 contains no toner 52 is measured. The internal friction coefficient $\mu t$ of the toner can be obtained from difference between these forces.

Figure 13:
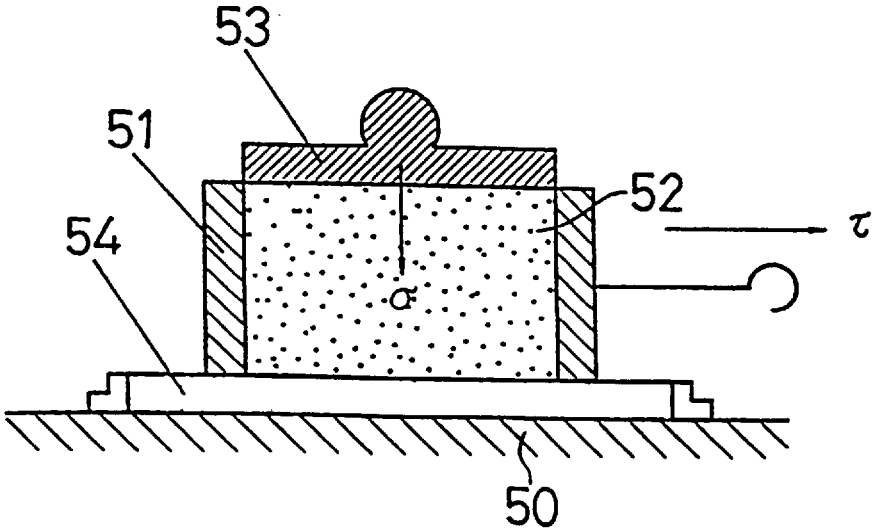
FIG. 13 is a sectional view illustrating a method for determining a friction coefficient $\mu rt$ between the toner and the developing roller 3 and a friction coefficient $\mu dt$ between the toner and the electric-charge-removing sheet 12.

FIG. 13 is a view showing a sectional view illustrating a method for determining the friction coefficient $\mu rt$ of the toner against the developing roller 3 and the coefficient $\mu dt$ of the toner against the electric-charge-removing sheet 12. A contact member 54 is fixed on a base 50, on which a cylinder 51 containing toner 52 in its cylindrical portion is placed. A weight 53 is placed thereon. The same material as that used for the developing roller 3 or the electric-charge-removing sheet 12 is used for the contact member 54. Thus, the friction coefficients $\mu rt$ and $\mu dt$ can be determined in the same way as in FIG. 12.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a width Wt of the toner layer on the developing roller in a direction of a rotating axis of the developing roller and an effective electric-charge-removing width Wc of the electric-charge-removing member satisfy a relation of $Wc \geqq Wt$, and an elastic member is provided at a side of the electric-charge-removing member which side is opposite to the developing roller side, and wherein the voltage-applying means of the electric-charge-removing means applies an AC voltage VAC to the electric-charge-removing member, and wherein a relation of $2\times|Vd-Vr|<VAC$ is satisfied, in which VAC is an AC voltage applied to the electric-charge-removing member, Vd is an AC voltage applied by the voltage-applying means of the electric charge-removing means, and Vr is an AC voltage applied by the voltage-applying means of the developing means.

2. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a width Wt of the toner layer on the developing roller in a direction of a rotating axis of the developing roller and an effective electric-charge-removing width Wc of the electric-charge-removing member satisfy a relation of $Wc \geqq Wt$, and wherein a length L of contact of the developing roller with the electric-charge-removing member in the rotating direction of the roller, a rotating speed $v_t$ of the developing roller, a dielectric constant $\epsilon$ of an electric-charge-removing member, a vacuum permittivity $\epsilon_o$, and a volume resistivity $\rho$ satisfy a relationship of $L \geqq 10\ v_t \epsilon \epsilon_o \rho$.

3. The developing apparatus of claim 2, wherein the voltage-applying means of the electric-charge-removing means applies an AC voltage VAC to the electric-charge removing member.

4. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a passing time t of the developing roller through the electric-charge-removing member, a dielectric constant $\epsilon$ of the electric-charge-removing member, a vacuum permittivity $\epsilon_o$, and a volume resistivity $\rho$ satisfy a relationship of $\epsilon \epsilon_o \rho < t$.

5. The developing apparatus of claim 4, wherein the voltage-applying means of the electric-charge-removing means applies an AC voltage VAC to the electric-charge-removing member.

6. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein an electric resistance value Rd of the electric-charge-removing member and an electric value Rt of the toner satisfy a relation of Rd is approximately equal to Rt.

7. The developing apparatus of claim 6, wherein the voltage-applying means of the electric-charge-removing means applies an AC voltage VAC to the electric-charge-removing member.

8. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein an electric-charge-removing current I, a toner mass per unit area m/a (wherein m is a mass of the toner layer on the developing roller) of the toner layer on the developing roller after passing of the toner through the charging member, a quantity of electric charge of the toner q/m (wherein q is a quantity of electric charge of the toner of the toner layer on the developing roller), a quantity of change in electric electric charge $\Delta q/m$ of the toner layer on the developing roller after passing of the toner through the developing position, a rotating velocity Vt of the developing roller, and an effective width for electric charge removal Wc of the electric-charge-removing member satisfy a relation of $I \geqq -(m/a)\cdot(q/m+\Delta q/m)\cdot v_t \cdot Wc$.

9. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a toner mass per unit area m/a of the toner layer on the developing roller after passage of the toner through the charging member, a quantity of electric charge q/m of the charged toner, a quantity of change in electric charge Δq/m of the toner layer on the developing roller after passing of the toner through the developing position, a rotating speed $v_r$ of the developing roller, an effective width for electric charge removal Wc of the electric-charge-removing member, a DC voltage Vd applied from the voltage-applying means of the electric-charge-removing means to the electric-charge-removing member, a DC voltage Vr applied from the voltage-applying means of the developing means to the developing roller, an electric resistance value Rd of the electric-charge-removing member, an electric resistance value Rt of the toner, and an electric resistance value Rr of the developing roller satisfy a relation of $(Vd-Vr) \geqq -(((m/a)\cdot(q/m+\Delta q/m)\cdot v_r\cdot Wc)\cdot(Rd+Rt+Rr))$.

10. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein an internal friction coefficient $\mu t$ of the toner, a friction coefficient $\mu rt$ between the toner and the developing roller, and a friction coefficient $\mu dt$ between the toner and the electric-charge-removing member satisify a relation of $\mu dt<\mu t<\mu rt$.

11. The developing apparatus of claim 10, wherein a surface roughness of an electric-charge-removing material contacting with the developing roller is selected within a range of 1/50 to ½ of a particle size of the toner.

12. The developing apparatus of claim 10, wherein an electric resistance value Rd of the electric-charge-removing member is selected within a range of $1\times10^{-5}$ Ω to $1\times10^{6}$ Ω.

13. The developing apparatus of claim 10, wherein a portion of a region of an effective width for electric charge removal Wc of the electric-charge-removing member, beyond a width Wt of the toner layer on the developing roller in a rotating axis direction is provided so as not to contact with the developing roller.

14. The developing apparatus of claim 10, wherein an electrically insulating member is formed on a surface of a portion of a region of an effective width for electric charge removal Wc of the electric-charge-removing member, beyond a width Wt of the toner layer on the developing roller in a rotating axis direction.

15. The developing apparatus of claim 10, wherein the developing apparatus has a vessel for accommodating the toner and the electric-charge-removing member is fixed so as to be sandwiched between the vessel and a metallic member.

16. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a resin material is applied to a developing roller side surface of the electric-charge-removing member so that an internal friction coefficient $\mu t$ of the toner and a friction coefficient $\mu dt$ between the toner and the electric-charge-removing member satisfy a relation of $\mu dt<\mu t$.

17. The developing apparatus of claim 16, wherein a surface roughness of an electric-charge-removing material contacting with the developing roller is selected within a range of 1/50 to ½ of a particle size of the toner.

18. The developing apparatus of claim 16, wherein an electric resistance value Rd of an electric-charge-removing member is selected within a range of $1\times10^{-5}$ Ω to $1\times10^{6}$ Ω.

19. The developing apparatus of claim 16, wherein a portion of a region of an effective width for electric charge removal Wc of the electric-charge-removing member, beyond a width Wt of the toner layer on the developing roller in a rotating axis direction is provided so as not to contact with the developing roller.

20. The developing apparatus of claim 16, wherein an electrically insulating member is formed on a surface of a portion of a region of an effective width for electric charge removal Wc of the electric-charge-removing member, beyond a width Wt of the toner layer on the developing roller in a rotating axis direction.

21. The developing apparatus of claim 16, wherein the developing apparatus has a vessel for accommodating the toner and the electric-charge-removing member is fixed so as to be sandwiched between the vessel and a metallic member.

22. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a width Wt of the toner layer on the developing roller in a direction of a rotating axis of the developing roller and an effective electric-charge-removing width Wc of the electric-charge-removing member satisfy a relation of $Wc \geqq Wt$, and an elastic member is provided at a side of the electric-charge-removing member which side is opposite to the developing roller side, and wherein the voltage-applying means of the electric-charge-removing means applies an AC voltage VAC to the electric-charge-removing member, and wherein the AC voltage VAC is applied to the electric-charge-removing member by the voltage-applying means of the electric-charge-removing means so that an effective electric field for the toner layer on the developing roller is approximately $3\times10^6$ V/m.

23. A developing apparatus comprising:

a rotary photoreceptor drum for carrying an electrostatic latent image;

developing means including a rotary conductive developing roller for carrying a single component toner which roller is placed in contact with the photoreceptor drum, and means for applying a voltage to the developing roller;

electrically charging means including a charging member for electrically charging the toner and regulating a toner layer on the developing roller in thickness, which member is placed at an upper stream side of a rotating direction of the developing roller than a developing position where the developing roller is in contact with the photoreceptor drum, and means for applying a voltage to the charging member; and means for removing electric charge, including an electric-charge-removing member for removing electric charge which is placed at a lower stream side of the rotating direction of the developing roller than the developing position, and means for applying a voltage to the electric-charge-removing member, wherein a width Wt of the toner layer on the developing roller in a direction of a rotating axis of the developing roller and an effective electric-charge-removing width Wc of the electric-charge-removing member satisfy a relation of $Wc \geqq Wt$, and an elastic member is provided at a side of the electric-charge-removing member which side is opposite to the developing roller side, and wherein a length L of contact of the developing roller with the electric-charge-removing member in the rotating direction of the roller, a rotating speed $v_t$ of the developing roller, a dielectric constant $\epsilon$ of the electric-charge-removing member, a vacuum permittivity $\epsilon_o$, and a volume resistivity $\rho$ satisfy a relationship of $L \geqq v_t \epsilon \epsilon_o \rho$.

* * * * *